US008234817B2

(12) United States Patent
Neundorf et al.

(10) Patent No.: US 8,234,817 B2
(45) Date of Patent: Aug. 7, 2012

(54) METHOD AND DEVICE FOR CONTROLLING THE CLOSING MOVEMENT OF A CHASSIS COMPONENT FOR VEHICLES

(75) Inventors: Robert Neundorf, Ebersdorf (DE); Georg Scheck, Weitramsdorf (DE); Stephan Starost, Memmelsdorf (DE); Uwe Klippert, Oberaula (DE); Dalibor Rietdijk, Wetzlar (DE); Karl-Heinz Bauer, Grossheirath (DE); Ulf Nitzsche, Coburg (DE)

(73) Assignee: Brose Fahrzeugteile GmbH & Co. KG, Coburg, Coburg (DE)

( * ) Notice: Subject to any disclaimer, the term of this patent is extended or adjusted under 35 U.S.C. 154(b) by 615 days.

(21) Appl. No.: 12/158,484

(22) PCT Filed: Dec. 18, 2006

(86) PCT No.: PCT/EP2006/069818

§ 371 (c)(1),
(2), (4) Date: Feb. 11, 2009

(87) PCT Pub. No.: WO2007/071641

PCT Pub. Date: Jun. 28, 2007

(65) Prior Publication Data

US 2009/0217596 A1 Sep. 3, 2009

(30) Foreign Application Priority Data

Dec. 21, 2005 (DE) ..... 10 2005 061 610

(51) Int. Cl.
*E05F 15/10* (2006.01)
*E05F 5/02* (2006.01)
*E06B 3/34* (2006.01)

(52) U.S. Cl. ..... 49/280; 49/28

(58) Field of Classification Search ..... 49/27, 28, 49/339, 340, 341, 344, 345, 356, 358, 359
See application file for complete search history.

(56) References Cited

U.S. PATENT DOCUMENTS 3,398,484 A * 8/1968 Katsumura et al. ..... 49/138
(Continued)

FOREIGN PATENT DOCUMENTS

DE 10155307 10/2001
(Continued)

OTHER PUBLICATIONS

International Search Report, Application No. PCT/EP2006/069818, mailed Mar. 16, 2007.

(Continued)

*Primary Examiner* — Katherine w Mitchell
*Assistant Examiner* — Justin Rephann
(74) *Attorney, Agent, or Firm* — Renner, Otto, Boisselle & Sklar, LLP

(57) ABSTRACT

To reduce stresses during closing of a manually closable body component, e.g. a door, a control device and a method of controlling closing movement in which, during the closing movement, from an opened position, the body component passes through first movement range in which the body component is moved towards the closed position without any action by a control member, and, thereafter, the body component passes through a second movement range in which the closing movement is varied by the action of the control member that residual kinetic energy of the body component does not exceed a predetermined limit value after passing through the second movement range, irrespective of the initial speed. The residual kinetic energy is not sufficient to close the body component automatically, so it is automatically drawn in a third movement range until a pre catch or main catch of a lock is reached.

18 Claims, 19 Drawing Sheets

U.S. PATENT DOCUMENTS

| | | | | |
|---|---|---|---|---|
| 4,530,185 | A * | 7/1985 | Moriya et al. | 49/280 |
| 4,644,693 | A * | 2/1987 | Wang | 49/280 |
| 4,674,230 | A * | 6/1987 | Takeo et al. | 49/32 |
| 4,689,849 | A | 9/1987 | Eger et al. | |
| 4,945,677 | A | 8/1990 | Kramer | |
| 5,076,016 | A | 12/1991 | Adams | |
| 5,369,911 | A * | 12/1994 | Fortunato | 49/25 |
| 5,468,042 | A * | 11/1995 | Heinrichs et al. | 296/146.4 |
| 6,111,326 | A | 8/2000 | Miyata et al. | |
| 6,175,204 | B1 * | 1/2001 | Calamatas | 318/375 |
| 6,359,762 | B1 | 3/2002 | Yokomori | |
| 6,425,206 | B1 | 7/2002 | Noda et al. | |
| 6,452,353 | B1 * | 9/2002 | Calamatas | 318/466 |
| 6,525,499 | B2 * | 2/2003 | Naganuma | 318/445 |
| 6,742,388 | B1 * | 6/2004 | Osentoski | 73/503.3 |
| 7,105,943 | B2 * | 9/2006 | Willats et al. | 307/10.1 |
| 7,637,057 | B2 * | 12/2009 | Matsui et al. | 49/345 |
| 7,866,003 | B2 | 1/2011 | Tooyama | |
| 2004/0020126 | A1 | 2/2004 | Matsui et al. | |
| 2006/0151231 | A1 | 7/2006 | Bucksch et al. | |

FOREIGN PATENT DOCUMENTS

| | | |
|---|---|---|
| DE | 4140197 | 6/2003 |
| DE | 10327448 | 6/2003 |
| EP | 0580147 | 1/1994 |
| EP | 1705330 | 9/2006 |
| JP | 09328961 | 12/1997 |
| JP | 10280802 | 10/1998 |
| JP | 2000160934 | 6/2000 |
| JP | 2004003350 | 1/2004 |
| JP | 2004106729 | 4/2004 |
| JP | 2005171573 | 6/2005 |
| WO | 2006072318 | 7/2007 |

OTHER PUBLICATIONS

German Search Report, Application No. 10 2005 061 610.0, dated Aug. 2, 2006.

Office Action for corresponding CN Application No. 200680053141.3 mailed Jul. 4, 2011 and English translation thereof.

JP 2008-546410; Japanese Office Action and English Translation mailed Sep. 21, 2010.

Office Action for corresponding JP Application No. 2008-546410 mailed May 17, 2011 and English translation thereof.

* cited by examiner

Mechanical energy storage device with "motor charging" (by window lifter motor ...)

19° DOOR OPEN

21° DOOR OPEN

75° DOOR OPEN (end stop)

20° DOOR IS CLOSED 0.3° DOOR IS LOCKED

0° DOOR IS LOCKED

METHOD AND DEVICE FOR CONTROLLING THE CLOSING MOVEMENT OF A CHASSIS COMPONENT FOR VEHICLES

This application claims priority of German Patent Application No. 10 2005 061 610.0, filed on Dec. 21, 2005, entitled "Method and device for controlling the closing movement of a body component for vehicles", the content of which is hereby expressly incorporated herein by way of reference.

FIELD OF THE INVENTION

The present invention relates to a method and a device for controlling the closing movement of a manually closable body component for vehicles, in particular for motor vehicles, e.g. a hinged door, sliding door, hinged/sliding door, bonnet, hinged cover, sliding roof or the like.

BACKGROUND OF THE INVENTION

Body components of the aforementioned type are nowadays closed largely by manual actuation. Slamming or banging often introduces too much energy into the closing process, as a result of which the body component and functional components supported therein or their suspension arrangements are subjected to a high degree of stress when the body component is closed as a result of the high acceleration. This leads, on the one hand, to expensive measures to prevent rattling in order to allow for rattle-free movement of the body component even in continuous use. On the other hand, the functional components and their bearing arrangements must be designed to be able to withstand high stresses for reliable continuous operation. Nowadays, motor vehicle doors have to be designed for approximately 100,000 or more loads with forces of acceleration of 30 g to 50 g, necessitating a complex design and bearing arrangement for these functional components and increasing the costs unnecessarily. It would therefore be desirable if the operator could be prevented in a reliable manner from manually closing or banging shut body components of the aforementioned type at too high a speed.

Measures are known from the prior art in which doors or the like are closed automatically by means of an electric drive. During normal operation, the door cannot be driven or actuated manually, thereby preventing the aforementioned problems in a reliable manner. An automatic door drive of this kind is of course relatively expensive and complex safety measures have to be taken in the case of system failure.

DE 41 40 197 C2 discloses a method of moving a power-operated component, in which the door is braked to such an extent during opening or closing that closing is only possible after another command, triggered by actuating an electric switch. Locking or complete closing of the door can only be effected manually. Compared to a manually closable door, the operator in this case has to learn a new system, which is often not desirable.

Power closing aids for power closing motor vehicles are also known from the prior art, as disclosed, e.g. in DE 101 55 307 A1 and DE 103 27 448 A1. However, door closing systems of this kind require the door to be closed to what is referred to as the pre catch. The aforementioned problems can still occur during manual closing of the door to the pre catch.

The following prior art should additionally be mentioned: DE 38 16 175 C2, corresponding to U.S. Pat. No. 4,945,677, discloses a hinged sliding door for motor vehicles.

DE 103 23 001 A1, corresponding to US 2004/0020126 A1, discloses a vehicle door device with a driving and closing mechanism, in which a control mechanism is provided in order to control the actuation of the driving and closing mechanism on the basis of a door closing command and in which a detection device is provided in order to detect whether a closing member is positioned within the range in which the closing member can be brought into engagement with a latch. A driving force reducing mechanism is furthermore provided in the control mechanism for reducing the power output of the driving mechanism once the detection device has detected that the closing member is positioned within the range in which the closing member can be engaged with the latch.

DE 102 45 192 A1, corresponding to US 2006/0151231 A1, discloses a device for closing a motor vehicle door. A first lock part is coupled to a switching element, the activation of a closing aid which transfers the lock parts into a locking position being dependent on the switching state thereof.

DE 1 580 047 A, corresponding to U.S. Pat. No. 3,398,484, discloses a device for the drive of a motor vehicle door.

U.S. Pat. No. 6,359,762 B1 discloses a method for controlling a powered sliding door. According to the method, the sliding speed is measured by a sensor once a predetermined interval has elapsed after the actuation of a drive motor of the sliding door. The measured sliding speed is compared with a lower limit speed in accordance with a value of the battery voltage of the vehicle. The movement of the sliding door is stopped or reversed if the sliding speed is lower than the lower limit speed. This is supposed to prevent malfunctions as a result of an insufficient power supply to the system. In particular, a reliable pinch protection is also supposed to be effected in this manner.

U.S. Pat. No. 5,076,016 discloses a powered motor vehicle sliding door with an electromagnetic clutch in order to drive a cable for opening and closing the sliding door.

Another problem encountered when closing body components of the aforementioned type is the jamming or pinch of objects or body parts during the closing process. A reliable pinch protection is therefore also desirable.

SUMMARY OF THE INVENTION

A primary object of the present invention is to at least partially mitigate the aforementioned problems. According to other aspects of this invention, a method and a device of the type mentioned at the outset should be designed in such a manner that the body component enters the completely closed state in a reliable manner with comparatively little, particularly defined residual kinetic energy. According to other aspects of this invention, a method and a device of the aforementioned type should furthermore be provided in a simple manner such that the complexity of the design and bearing arrangement of functional components of the body component can be reduced. According to other aspects of this invention, a reliable pinch protection should furthermore be ensured.

These and other objects are solved according to the present invention by a method according to claim 1 and a device having the features according to claim 18. Other advantageous embodiments form the subject matter of the related dependant claims.

The present invention therefore departs from a method for controlling the closing movement of a manually closable body component for vehicles, in particular for motor vehicles, e.g. a hinged door, sliding door, hinged/sliding door, bonnet, hinged cover, sliding roof or the like. In the method, during the closing movement, departing from an opened position, the body component passes through a first movement range in which the body component is moved towards the closed position without any action by a control member, following the first movement range, the body component then passing through a second movement range in which the closing movement of the body component is varied in such a manner by the action of the control member that the residual kinetic energy of the body component does not exceed a predetermined limit value after passing through the second movement range.

While the body component can be closed, in particular also banged shut, manually without restrictions in the first movement range, varying the state of movement irrespective of the speed or kinetic energy predetermined in the first movement range ensures that the body component enters the closed state at a comparatively low speed and with comparatively little kinetic energy. The functional elements of the body component and their bearing arrangements can therefore be designed in a simpler and less stable manner according to the invention, offering considerable cost advantages. Nevertheless, reliable continuous operation of the body component can be ensured according to the invention.

According to another embodiment, the residual kinetic energy at the end of the second movement range is not sufficient to close the body component automatically or to transfer it to a pre catch or main catch of a lock. Damage to the body component and its functional elements and their bearing arrangements as a result of excessive acceleration at the beginning of or during the closing process can thus be avoided in an even more reliable manner.

According to another embodiment, following the second movement range, the body component passes through a third movement range in which a driving device drives it to the pre catch or main catch of the lock. In this third movement range, the body component is therefore closed under controlled, preset conditions, as a result of which damage to the body component and its functional elements and their bearing arrangements as a result of excessive speed during entry into the closed state can be prevented according to the invention.

The closing process according to the invention is characterised by a high degree of user-friendliness. The operator simply has to slam or bang the body component shut manually at the beginning of the closing process. A control unit then ensures that the body component is braked sufficiently. The body component is then power closed or closed automatically. A habituation effect rapidly sets in during operation, so that the operator rapidly learns to slam or bang the body component shut at a sufficient speed and relies on the remainder of the closing process being carried out automatically in a safe and reliable manner.

According to another embodiment, the driving device is driven by exhausting an energy storage device which is replenished during the manual opening and/or closing of the body component by braking or damping an opening and/or closing movement. By converting some of the energy introduced when opening and/or closing the body component manually, not only is energy saved for driving the power closing aid in the third movement range, but the body component can also have a simpler design. In particular, a separate energy supply, in particular, power supply, for a drive for the power closing aid can also essentially be dispensed with.

According to another alternative embodiment, the energy storage device is replenished by operating a servomotor serving for an movement function other than the closing and/or opening of the body component, e.g. by a window lifter motor, a lock drive, a central locking motor or an electric arm rest servomotor. The use of one and the same drive motor for different functions helps to save on costs and weight.

According to another embodiment, the body component is driven to the pre catch or main catch of the lock by an electric motor in the third movement range. The closing movement is thus preferably effected in such a manner that, in the case of jamming or pinch, either the drive is overridden or the motor reverses so as to produce a pinch protection function. As a result of the low closing speed in the third movement range, according to the invention, jamming or pinch cannot lead to greater damage in any case.

According to another embodiment, the closing movement of the body component is braked by means of a coupleable braking device until the predetermined residual kinetic energy level has been reached. A clutch device can be provided to this end. Or, the geometric design of the body component, the associated vehicle opening and the arrangement of the braking device ensure that the braking device is only coupled to the closing movement of the body component when the second movement range is reached, without the use of an additional clutch device.

According to another embodiment, the braking rate of the braking device increases as the closing speed of the body component increases, preferably in a non-linear manner. This results in a gentle, smooth, continuous transition of the closing movement from the second to the third movement range, thereby allowing for great ease of operation and leading to more trouble-free continuous operation.

According to another embodiment, the braking rate of the braking device is varied as a function of the determined speed and/or acceleration of the closing movement or of the determined closing path traveled by the body component. An electronic control device, in particular a microprocessor, is preferably provided to this end, continuously monitoring the momentum of the body component and intervening in a controlling manner in order to ensure the setpoint state of movement at the end of the second movement range.

According to another embodiment, the braking rate of the braking device is furthermore varied as a function of the model or manufacturer of the body component, the position of the vehicle, the identification of a user of the vehicle and/or an output signal from a logic unit, in particular a fuzzy logic unit or a neural network. The fuzzy logic unit or the neural network allows the electronic control unit to learn a typical closing process of an operator, who can also be identified, and to intervene in the closing process in a suitably controlling manner in the knowledge of a typical closing process.

A method according to any of the preceding claims, in which the limits between the movement ranges are constant.

Another aspect of the present invention relates to an electronic control program which, when the latter is executed by a processor means, e.g. a control IC or microprocessor, ensures that the aforementioned steps of the method of controlling the closing movement of a body component of the aforementioned type are carried out.

Another aspect of the present invention relates furthermore to a device for controlling the closing movement of a body component of the aforementioned type, as described hereinbefore.

DESCRIPTION OF THE FIGURES

The invention will now be described by way of example with reference to the accompanying drawings, from which further features, advantages and objects to be solved will become clear. In these drawings.

In all of the Figures, elements or groups of elements which are identical or which exercise similar effects are designated by identical reference numerals.

DETAILED DESCRIPTION OF PREFERRED EXEMPLARY EMBODIMENTS

A method for controlling the closing movement of a motor vehicle hinged door according to the invention will now be described with reference to FIG. 1. Door opening angles are specified by way of example in the left-hand column, although these can be selected differently or varied. This Figure departs from a hinged door having a braking or damping device for braking or damping the door closing movement and a drive for driving the door closing movement. A clutch serves to engage the braking or damping device in the power flow between the door and the vehicle body. This clutch, like the drive, can be controlled electronically, although it can also be opened and closed mechanically. As will be described in more detail hereinafter, the drive can be an electric drive or a purely mechanical drive, supplied by an energy storage device charged during the opening and/or closing of the vehicle door or by an additional electric motor serving for another adjustment movement, as described hereinafter.

Figure 1:
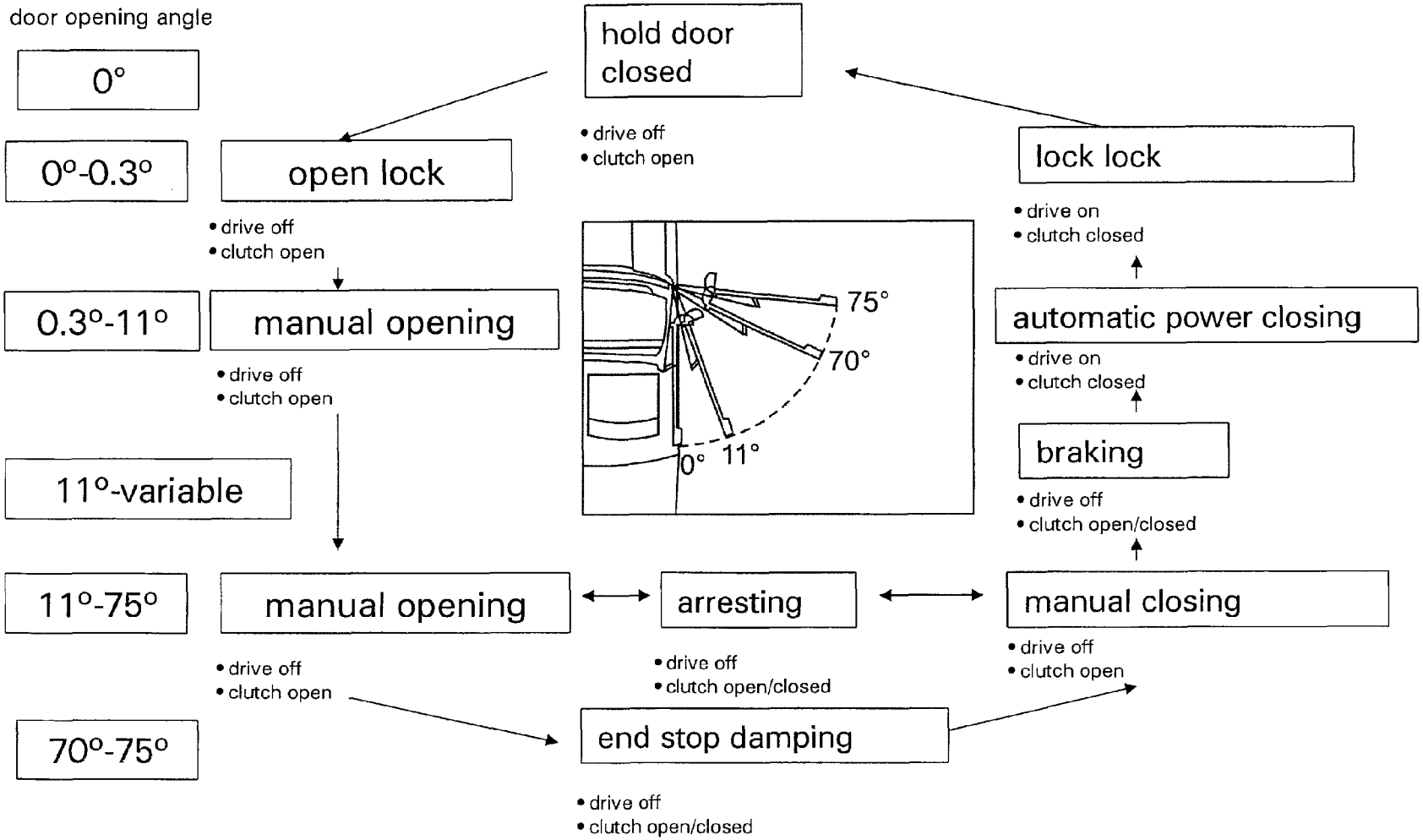
FIG. 1 is a schematic overview of the steps carried out to close a hinged door in a method according to this invention, together with a comparison of the steps carried out when opening the hinged door.

According to the right-hand column of FIG. 1, the closing process begins with manual closing in a first movement range (door opening angle 75° to 20° or up to another variably preset opening angle) in which the drive is switched off and the clutch is open, so that the door can be closed without restrictions in the first movement range. This closing can be effected manually or by slamming the door shut. Depending on the user, the speed of the door in the first movement range varies sometimes considerably during manual guiding or slamming of the door.

The first movement range is followed by a second movement range in which the door closing movement is braked, with the aim that the door should not exceed a predetermined maximum speed or maximum kinetic energy level at a predetermined angle, which is 11° in the exemplary embodiment shown, although the invention is not to be limited thereto. This maximum speed or maximum kinetic energy level is predetermined in such a manner according to the invention that the door cannot be closed automatically, i.e. without an additional drive, as a result of the residual kinetic energy at the end of the second range. The drive also remains switched off during the braking in the second movement range. Controlled braking of the door closing movement in the second movement range is obtained by suitable opening and closing of the clutch until the defined setpoint conditions with respect to door speed, torque, kinetic energy and the like are fulfilled at the end of the second range. As will be described in more detail hereinafter, some of the kinetic energy of the door can be stored temporarily in an energy storage device by closing the clutch and engaging the braking device, this then serving for a driving device for power closing the door in a third movement range following the second movement range. Energy storage devices of this kind can be based on a mechanical, pneumatic, hydraulic, electrical, magnetic or, in principle, even chemical method of operation.

The aforementioned conditions at the end of the second range (with an opening angle of approximately 11° in the exemplary embodiment shown) can, in particular, be selected in such a manner that safety aspects are taken into account. This may be: observing a maximum jamming or pinch force in the rear or front region of the door, in particular in the region of the vehicle B-column, e.g. in compliance with legal requirements; observing a maximum closing speed so that when the door enters a sealing section and the door lock enters an associated locking section, in particular locking bolt, a maximum negative acceleration is not exceeded, so that an excessively stable design for the door elements and their suspension or bearing arrangements is not absolutely necessary according to the invention. In particular, excessive slamming of the door can thus also be prevented in a reliable manner.

According to the right-hand column of FIG. 1, the second movement range is followed by a third movement range in which the door is power closed automatically. To this end, the drive is switched on and the clutch for engaging the drive force is closed. The power closing movement of the door is effected either at a constant or at a variable, in particular decreasing, speed. The vehicle door is closed almost completely or completely at the end of the third range, as indicated by the door opening angle of 0.3° specified by way of example. Particularly in the case of door systems in which sealing forces originating from sealing resilience do not have to be overcome with the aid of a corresponding reduction in the speed of the drive, the door can also be completely closed at the end of the third range.

According to FIG. 1, the third movement range is followed by a fourth movement range in which the door lock is locked. To this end, the drive is switched on and the clutch is closed in order to close the power flow. In systems in which a high sealing force has to be overcome, it may be necessary to reduce the speed of the drive accordingly in this fourth movement range. E.g. motor-operated power closing devices can be used for automatically power closing the door, as known from the prior art, e.g. from DE 101 55 307 A1 or DE 102 31 825 A1. In particular, a lever element acted upon by a motor-operated drive can be used to overcome large sealing forces, as is known, e.g. from DE 103 27 448 A1. The content of the aforementioned publications is hereby expressly incorporated into this application for the purposes of disclosure by way of reference.

The door is then held closed, the drive switched off and the clutch opened. In the case of a mechanical power closing aid, the power closing aid can therefore be returned to its starting position. According to the left-hand column of FIG. 1, the drive remains switched off during the entire opening process and the clutch open so that the door can be opened without restrictions.

During the entire door opening and closing process, sensors can monitor the state of movement and/or the surroundings of the door. As will be described hereinafter, output signals from these sensors can be output to an electronic control unit for controlling the door movement. These sensors can sometimes also be replaced by purely mechanically operating feelers, as described hereinafter. An example of a sensor for detecting the opening angle and, derived therefrom, the angular speed and the angular acceleration of a hinged door is a potentiometer, provided on a door hinge or coupled thereto. Sensors of this kind may of course also be produced resistively, capacitatively, magnetically, optoelectronically or in some other manner. Sensors for detecting a state of jamming or pinch, which can also be detected by an electronic control device, in order to trigger breaking or reversing of the door can also be produced in a comparable manner.

Another example of a sensor of this kind will be clear from FIG. 1, i.e. a stop sensor monitoring an outer surface of the vehicle door, e.g. an optical sensor, in particular infrared sensor, or an ultrasonic sensor which monitors the surroundings of the outer surface of the vehicle door for the risk of collision with an obstacle situated in the vicinity. If this is the case, according to FIG. 1, the clutch may be closed in order to close the power flow to the braking device and to obtain suitable braking of the door during manual opening and subsequent arresting of the door, thereby preventing collision with the obstacle. During a normal opening process, on the other hand, the clutch is only closed when a maximum door opening angle is reached, approximately 75° in the exemplary embodiment shown, in order to brake the door to a stop (end stop damping). According to exemplary embodiments of the invention, this same braking device is used both for braking the door during closing and during opening. According to FIG. 1, this braking device can also be used to arrest the door at a predetermined door opening angle by closing the clutch.

Figure 2:
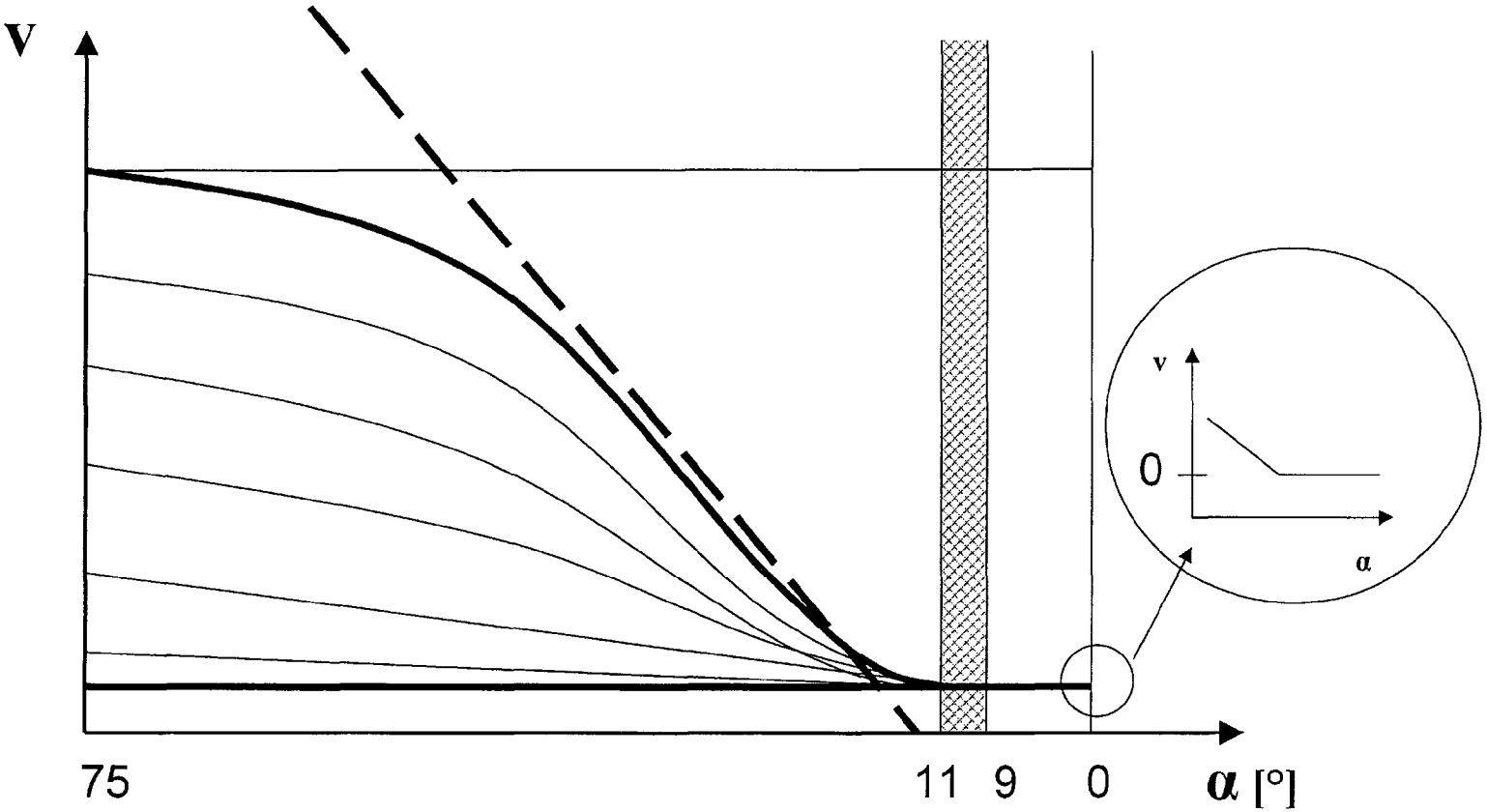
FIG. 2 plots curves showing the speed of a hinged door over the opening angle for different initial speeds by way of example.

The closing behaviour of a vehicle door according to the present invention when it is slammed shut manually at different initial speeds will now be described with reference to FIG. 2. FIG. 2 shows a hinged door, with the broken line symbolising a negative limit acceleration of 5 g. The solid line corresponds to a maximum permissible speed of 0.1 m/s in the embodiment shown. According to FIG. 2, the speed of the door decreases in a linear manner at first as a result of frictional forces, until the braking device is finally engaged by closing the clutch in order to brake the door. In the case of a door with an electronic control device, this engagement can be triggered by an electronic signal. According to FIG. 2, the door is braked to a differing extent depending on the actual variation in speed, which is monitored continuously, until the maximum permissible speed is finally reached at the end of the aforementioned second range. As indicated by the hatched angular range, the limit between the aforementioned second and third movement ranges can also be varied according to the invention, as described hereinafter. According to FIG. 2, the door is then power closed at a constant speed in the third movement range. As indicated by the insert in FIG. 2, the speed of the door finally decreases to zero as it enters the seal.

According to the invention, advance (proactive) braking of the door can also be achieved by means of an electronic control device. For example, if a comparatively high initial speed or dynamic accelerating door slamming is detected, it may be provided that the clutch is closed relatively early or that the braking device is engaged relatively early in order to close the door more gently than in the case where the door is slammed or guided shut comparatively slowly. Furthermore, in the case of an electronic control device, the closing of the clutch can also be made dependent on the user by identifying the user. An additional fuzzy logic unit which "learns" typical closing behaviour for the respective user can be provided to this end. The respective user is identified in this connection, e.g. by means of a chip card or RF tag carried by the latter and the data sets determined for the respective door closing process are averaged or "learnt" to give a normal data set for a normal door closing process for the respective operator. If the fuzzy logic unit signals to the control device that typically very heavy door slamming is to be expected from the person about to actuate it, it can be provided according to the invention that the control device closes the clutch earlier in order to engage the braking device and produce gentle closing of the door even in the case of high initial speeds or dynamic door slamming. Finally, another parameter which can influence the action of the electronic control unit according to the invention may be the position of the vehicle. If the vehicle parks, e.g. on a slope with expected additional acceleration of the door during closing, the electronic control unit can intervene proactively earlier than in the case of horizontal alignment of the vehicle.

Figure 3A:
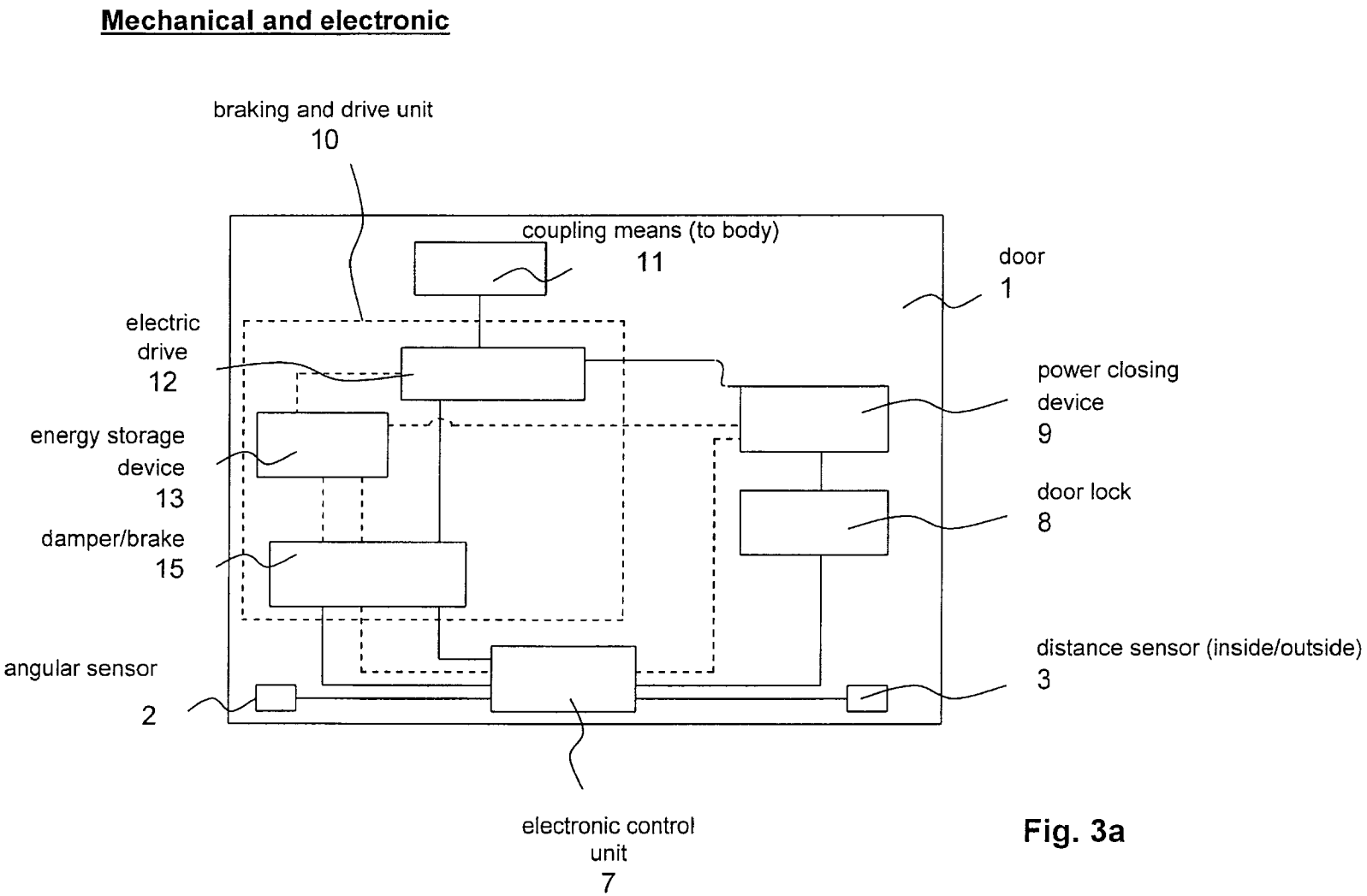
FIG. 3*a* is a schematic diagram showing a mechatronic door closing system according to this invention.

Embodiments of door closing systems according to the invention will now be described with reference to FIGS. 3*a* to 3*c* in diagrammatic form. FIG. 3*a* departs from a mechatronic door closing system with a central electronic control unit. According to FIG. 3*a*, the door 1 includes an angular sensor 2 which detects the opening angle and, derived therefrom, the angular speed and angular acceleration of the door 1, as well as a distance sensor 3 which detects the distance of the rear and/or front end of the door 1 from an edge of the body opening, e.g. the vehicle B-column, and/or the distance of the outer surface of the door 1 from obstacles. The output signals from the sensors 2, 3 are transmitted to the electronic control unit 7 for further evaluation. According to FIG. 3*a*, the door 1 further includes a brake 15 which can be engaged and disengaged by means of a clutch device (not shown), an electric drive 12 which can be engaged and disengaged by means of the same or another clutch device (not shown), a coupling means 11 which couples the electric drive 12 of the door to the vehicle body, a power closing device 9 and a door lock 8. As indicated by the broken line, the brake 15 and the drive 12 can be combined to form a braking and drive unit 10 which can be engaged and disengaged as required by means of a clutch (not shown). According to FIG. 3*a*, the drive 12 is coupled to the power closing device 9 in order to power close the door. The electric drive 12 serves furthermore to lock the door lock 8.

The clutch device, the brake 15, the drive 12, the power closing aid 9 and the locking of the door lock 8 are controlled by means of control signals from the electronic control unit 7. As indicated by the broken lines, an energy storage device 13 which can be charged by converting kinetic energy of the door during braking and which supplies the electric drive 12 and/or the power closing device 9 exclusively or additionally with energy can furthermore be provided. In principle, it is preferred according to the invention to provide the drive 12 in the door 1, as a drive for the power closing device 9 can thus be produced in a simple manner. However, according to the invention, the drive can in principle also be arranged on the body.

Figure 3B:
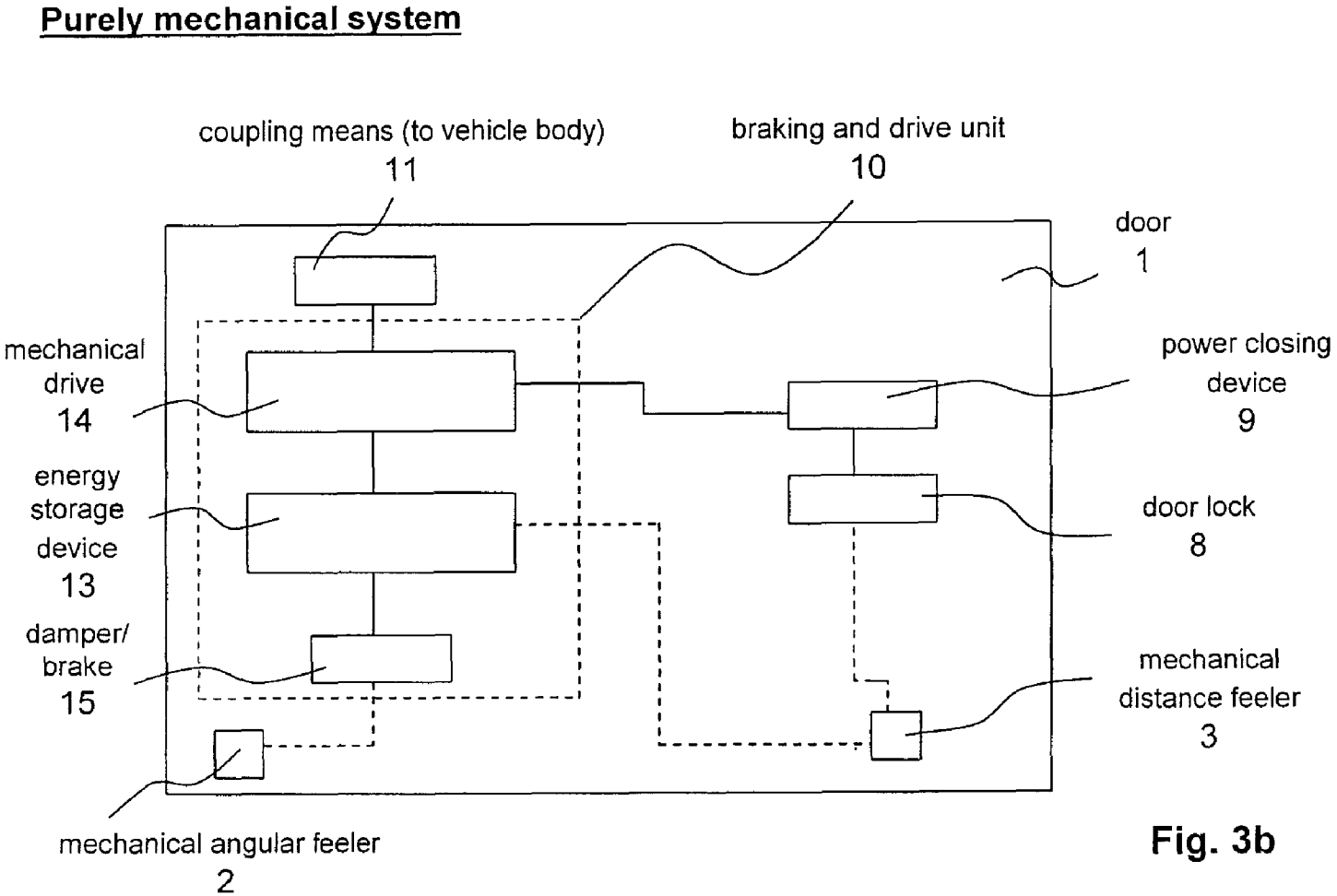
FIG. 3*b* shows a purely mechanical door closing system according to this invention.

FIG. 3*b* shows a door closing system according to the present invention operating exclusively with mechanical elements. The angular sensor according to FIG. 3*b* is consequently replaced by a mechanical angular feeler 2 and the distance sensor 3 according to FIG. 3*a* is replaced by a mechanical distance feeler 3. According to FIG. 3*b*, the mechanical angular feeler is coupled to the damper or the brake 15 in order to actuate the latter in a suitable manner. The kinetic energy released during braking is stored temporarily in a mechanical energy storage device 13, in particular a biasing spring system, as described hereinafter. The energy storage device 13 is activated to release the stored energy, triggered by a signal from the mechanical distance feeler 3, in order to drive the mechanical drive 14 which is in turn coupled to the power closing device 9 and the door lock 8 in order to power close the door and lock the door lock 8. In order to power close the door, the mechanical drive 14 is coupled to a coupling means 11 for coupling the door to the vehicle body. As indicated by the broken line, the damper or the brake 15, the energy storage device 13 and the mechanical drive 14 can be combined to form a braking and drive unit 10. In this system, the energy storage device 13 is charged in the aforementioned second movement range during the closing of the door. Or, the energy storage device 13 is charged during the opening of the door. Finally, if the mechanical distance feeler 3 signals that the door 1 is at a predetermined distance from the edge of the body opening, the power closing device 9 is activated in order to power close the door and locking of the door lock 8 is then triggered.

Figure 3C:
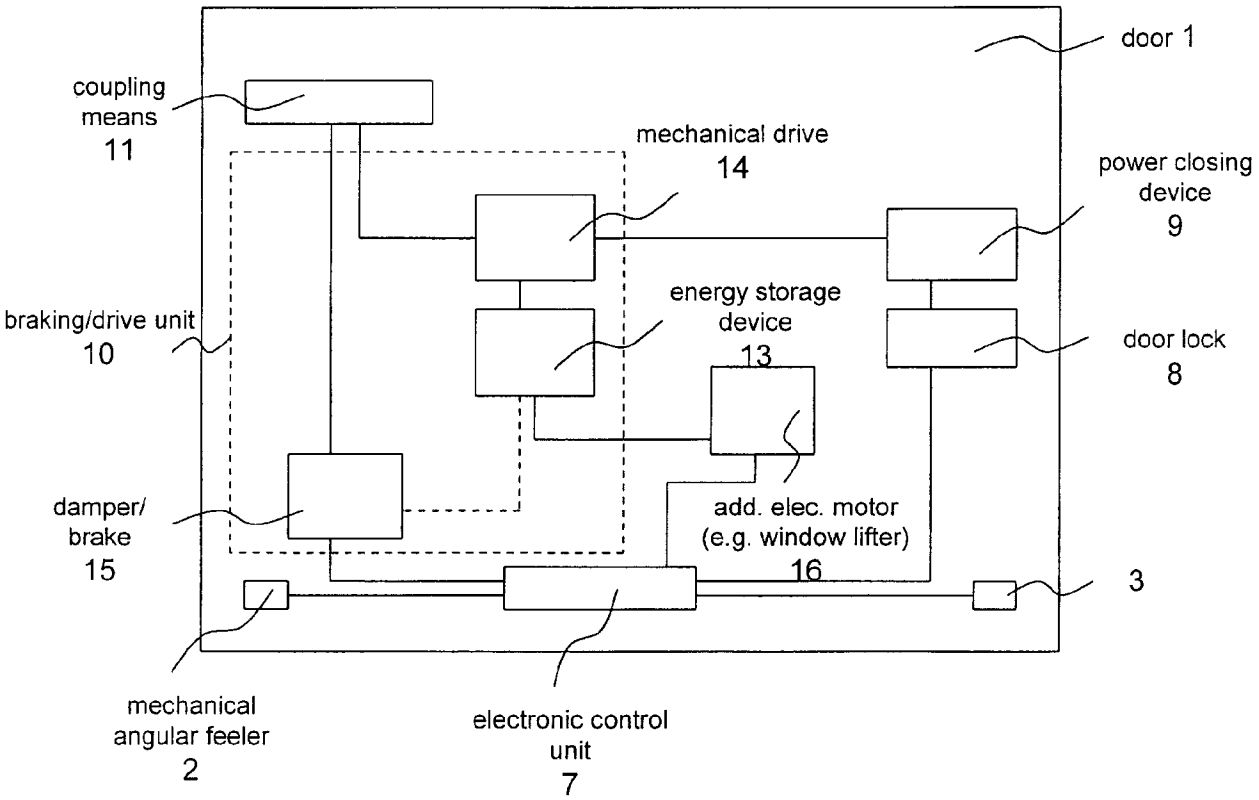
FIG. 3*c* shows a mechatronic door closing system according to this invention, in which an electric motor serving for another movement function serves to charge a mechanical energy storage device.

FIG. 3*c* shows a door closing system according to the invention with a central electronic control unit in which the energy storage device 13 is additionally charged by an additional electric motor 16 provided in the door 1 and serving a purpose other than the adjustment or movement of the door 1, e.g. as a window lifter motor, lock drive, central locking motor or electric arm rest servomotor. Deviating from FIG. 3*a*, the energy storage device 13 can additionally be coupled to the additional electric motor 16, the coupling and activation of the electric motor 16 being triggered by a control signal from the electronic control unit 7.

Figure 4:
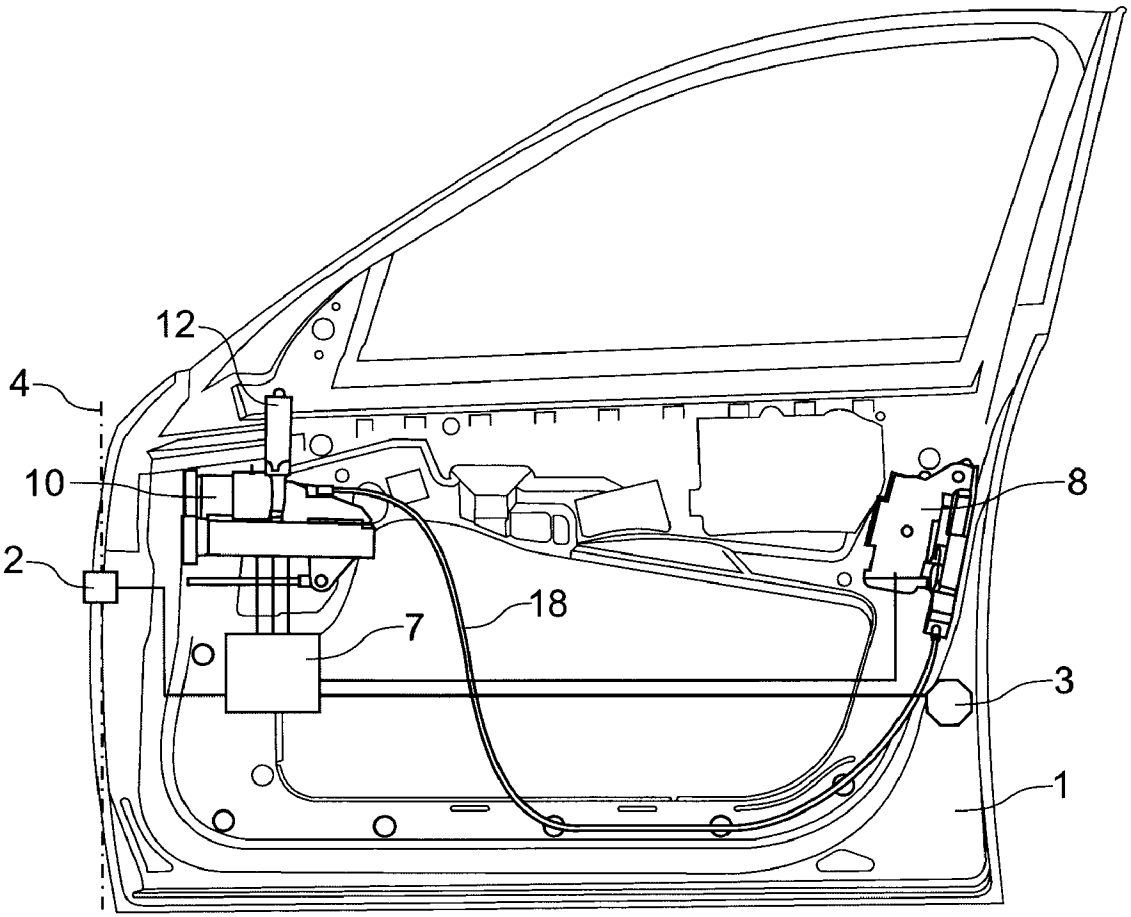
FIG. 4 is a diagrammatic side view of a motor vehicle door with the closing system according to FIG. 3*a;*

FIG. 4 shows an embodiment of a mechatronic door closing system according to FIG. 3*a*, the method of operation of which will now be described with reference to FIGS. 5*a*-5*d*. According to FIG. 4, the door 1 includes a braking and drive unit 10 coupled by means of a coupling rod or the like to a fixed reference point on the vehicle body and having its own electric motor 12. The door 1 can pivot about a pivot axis 4, an angular sensor, in particular a potentiometer, continuously detecting the opening state of the door 1 and, derived therefrom, the angular speed and angular acceleration thereof. A distance sensor 3 is furthermore provided, continuously monitoring the distance of the rear end of the door 1 from the edge of the body opening. The signals from the sensors 2 and 3 are output to the electronic control unit 7 which controls the braking and drive unit 10 and the door lock 8 in a suitable manner. The braking and drive unit 10 serves not only to power closer the door 1 when the aforementioned third range is reached, but also to drive the locking of the door lock 8. To this end, the braking and drive unit 10 actuates the cable of the Bowden cable 18 which couples the unit 10 to the door lock 8 in order to obtain locking of the door lock 8 in the known manner. The design and method of operation of the braking and drive unit 10 will now be described with reference to FIGS. 5*a*-5*d* in the case of one exemplary embodiment of a mechatronic door closing system.

Figure 5A:
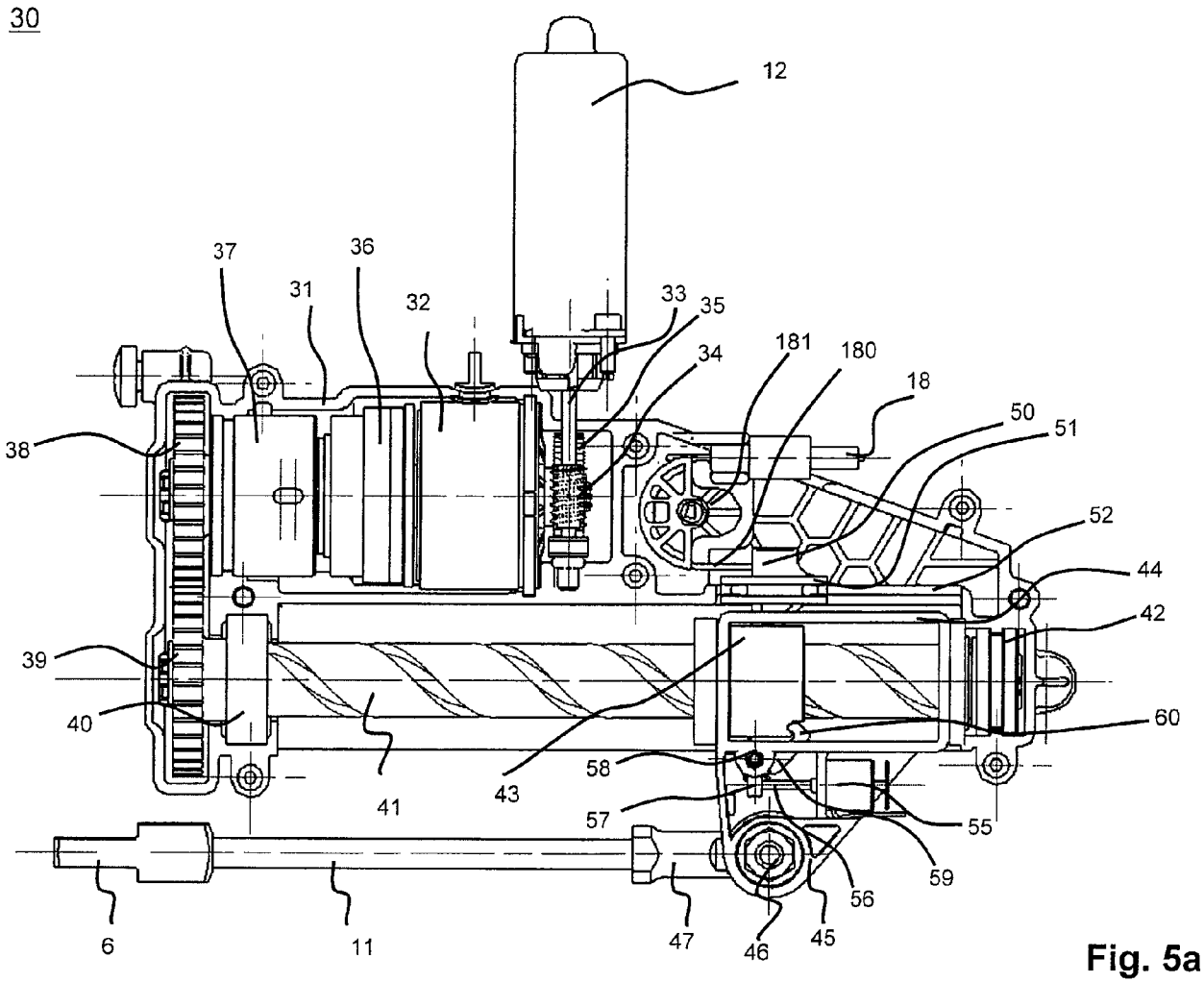
FIGS. 5*a*-5*d* show exemplary embodiments of a mechatronic door closing system according to FIG. 3*a* in four different states of operation.

FIG. 5*a* shows a mechatronic braking and drive unit 30 in a state for opening the door lock (not shown). According to FIG. 5*a*, a spindle 41 is supported in bearings 40, 42 in the housing 31 of the unit 30. A spiral inner groove engaged by a projection on the inner circumferential surface of the spindle nut 43 extends on the outer circumference of the spindle 41. A spindle nut cage 44 receiving the spindle nut 43 is seated slidably and snugly on the moreover smooth cylindrical outer circumferential surface of the spindle 41. A hook 60 of the pivoted lever 59 pivotable about the pivot axis 58 snaps into a corresponding recess in the spindle nut 43 in the opened position according to FIG. 5*a* in order to couple the spindle nut 43 to the spindle nut cage 44 and the running carriage 45. A stop surface 57, against which a lifter 56 of the lifting magnet 55 supported on the running carriage 45 bears, is provided at the other end of the pivoted lever 59. By moving the lifting magnet 55 and the lifter 56, the pivoted lever 59 can be pivoted about the pivot axis 58 and the hook 60 can be brought out of engagement with the recess in the spindle nut 43, as described hereinafter. The lower end of the running carriage 45 is coupled by means of an end piece 47 to a coupling rod 11 which couples the unit 30 to a fixed reference or coupling region 6, as indicated schematically by the reference numeral 6. The coupling rod 11 is mounted to pivot about a pivot axis 46 situated perpendicularly to the plane of the drawing.

According to FIG. 5*a*, the gear 39 rigidly connected to the left end of the spindle 41 meshes with the gear 38 rigidly connected to the axis of rotation of two gear stages 37, 36. A gear 35 which meshes with the screw 34 seated on the drive shaft 33 of the electric motor 12 is seated at the other end of this axis. An electromagnetic brake 32 actuated by an electronic control device (not shown) is seated between the electric motor 12 and the gear stage 36 in order to brake the rotational movement of the spindle 41 in a suitable manner, and indeed in the known manner by contact pressure between clutch discs rubbing against one another.

According to FIG. 5*a*, a tab of the driving element 50 to which the cable 180 of the Bowden cable 18 for actuating the door lock is fastened engages in a recess at the upper end of the spindle nut 43. A sliding guide 51 formed by two parallel webs arranged at a distance from one another is provided on the driving element 50 and is slidably guided parallel to the axial direction of the spindle 41 on a longitudinal rib 52 of the housing 31. In the position according to FIG. 5*a*, in which the spindle nut 43 is seated at the left end of the spindle nut cage 44, the cable 180 of the Bowden cable 18 is relaxed. As described hereinafter, the cable 180 deflected by the semicircular cable deflection piece 181 can be actuated by displacing the driving element 50, driven by the spindle nut 43.

In the state according to FIG. 5*a*, the door is closed to what is referred to as the pre catch of the door lock. Departing from this state, a switching process for transferring the door lock to the main catch will now be described with reference to FIGS. 5*a* and 5*b*. To this end, in the state according to FIG. 5*a*, the motor 12 is first reversed and the clutch 32 closed so that the electric motor 12 moves the spindle nut 43 in the spindle nut cage 44 fully to the left by rotating the spindle 41 in order to release the snap-in hook 60 of the pivoted lever 59 in an optimum manner. The lifting magnet 55 is then actuated in order to pivot the pivoted lever 59 about the pivot axis 58 in a clockwise direction by pressing the lifter 56 against the stop surface 57 and to thus bring the snap-in hook 60 of the pivoted lever 59 out of engagement with the recess 49 (cf. FIG. 5*b*) in the spindle nut 43.

Figure 5B:
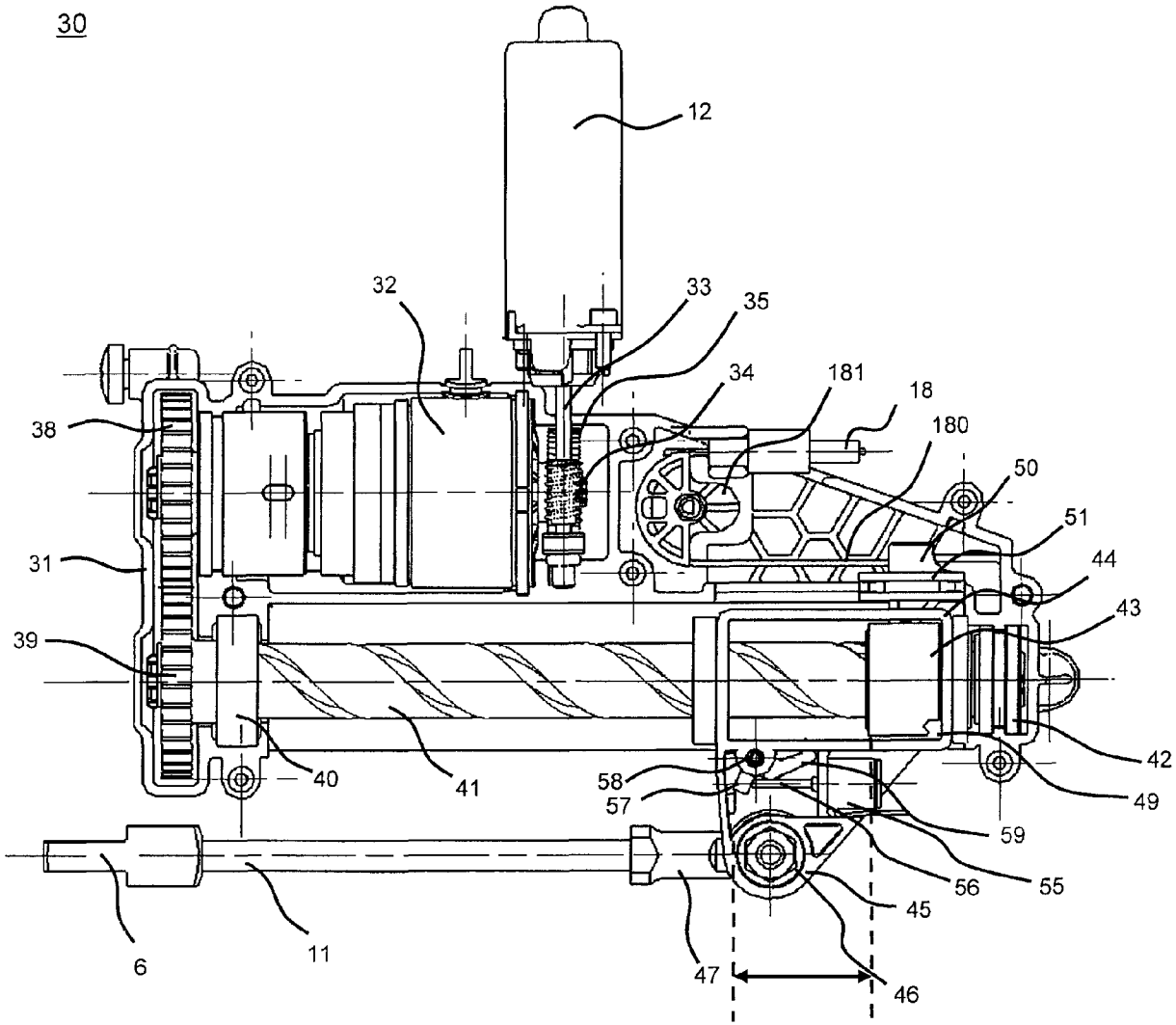

The electric motor 12 then reverses in order to move the spindle nut 43 in the spindle nut cage 44 to the right in FIG. 5*b* by rotating the spindle 41, until the spindle nut 43 has finally reached the right edge of the spindle nut cage 44 according to FIG. 5*b*. The driving element 50 slidably supported in the sliding guide 51 is carried along by the spindle nut 43 as a result of the engagement of the tab of the driving element 50 in the spindle nut 43. The tensile force thus exerted on the cable 180 of the Bowden cable 18 brings about the switching process of the door lock from the pre catch to the main catch. The locking range of the spindle nut 43 provided to this end is indicated by a double arrow in FIG. 5*b*.

The main catch of the door lock is detected by a sensor situated in the door lock, the output signal of which is evaluated by an electronic control unit. The electronic control unit then reverses the electric motor 12 once again in order to move the spindle nut 43 in the spindle nut cage 44 back to the left by rotating the spindle 41. The driving element 50 engaging in the spindle nut 43 thus relaxes the cable 180. In this state, if the door lock remains in the main catch, then it is held closed. The lifting magnet 55 then moves the lifter 56 back so that the spring-loaded pivoted lever 59 pivots backwards about the pivot axis 58 in a counter-clockwise direction and the snap-in hook 60 of the pivoted lever 59 engages once again in the recess 49 in the spindle nut 43. In this state, the door remains held closed in the main catch. In this state, the spindle nut cage 44 is situated at the right end of the spindle 41 and the spindle nut 43 is situated at the left end of the spindle nut cage 44.

Figure 5C:
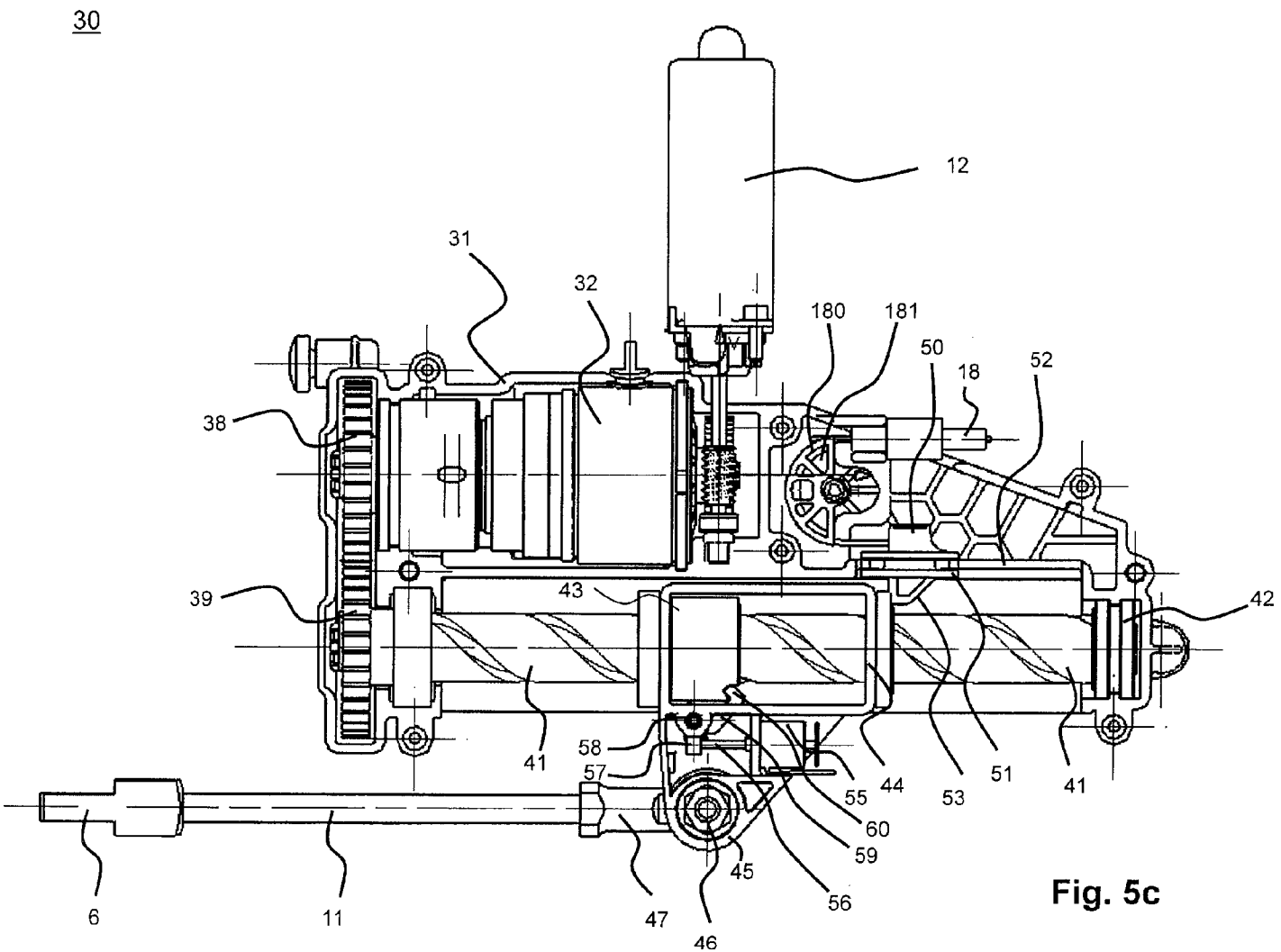

The door lock is opened in the known manner by actuating the door handle. The door is then pivoted open manually. The coupling rod 11 pulls the running carriage 45 along the spindle 41 to the left, as shown in FIG. 5*c* in the case of an intermediate position during the manual pivoting open operation of the door. As the snap-in hook 60 of the pivoted lever 59 engages in the recess in the spindle nut 43, the spindle nut 43 with the spindle nut cage 44 is carried along passively. The driving element 50 thus remains at the left end region of its movement path, as shown in FIG. 5*c*, so that the tab 53 of the driving element 50 comes out of engagement with the corresponding recess on the outer circumference of the spindle nut 43.

By pivoting the door open further, the running carriage 45 is finally transferred to an end position corresponding to the state in which the door is pivoted open to the maximum extent. A stop provided at the left edge of the spindle nut cage 44 or running carriage 45 can thus come to bear against a stop surface of the housing 31. Rubbery-elastic damping elements (not shown in FIGS. 5*a*-5*d*) can be provided in this region for the end stop damping.

Figure 5D:
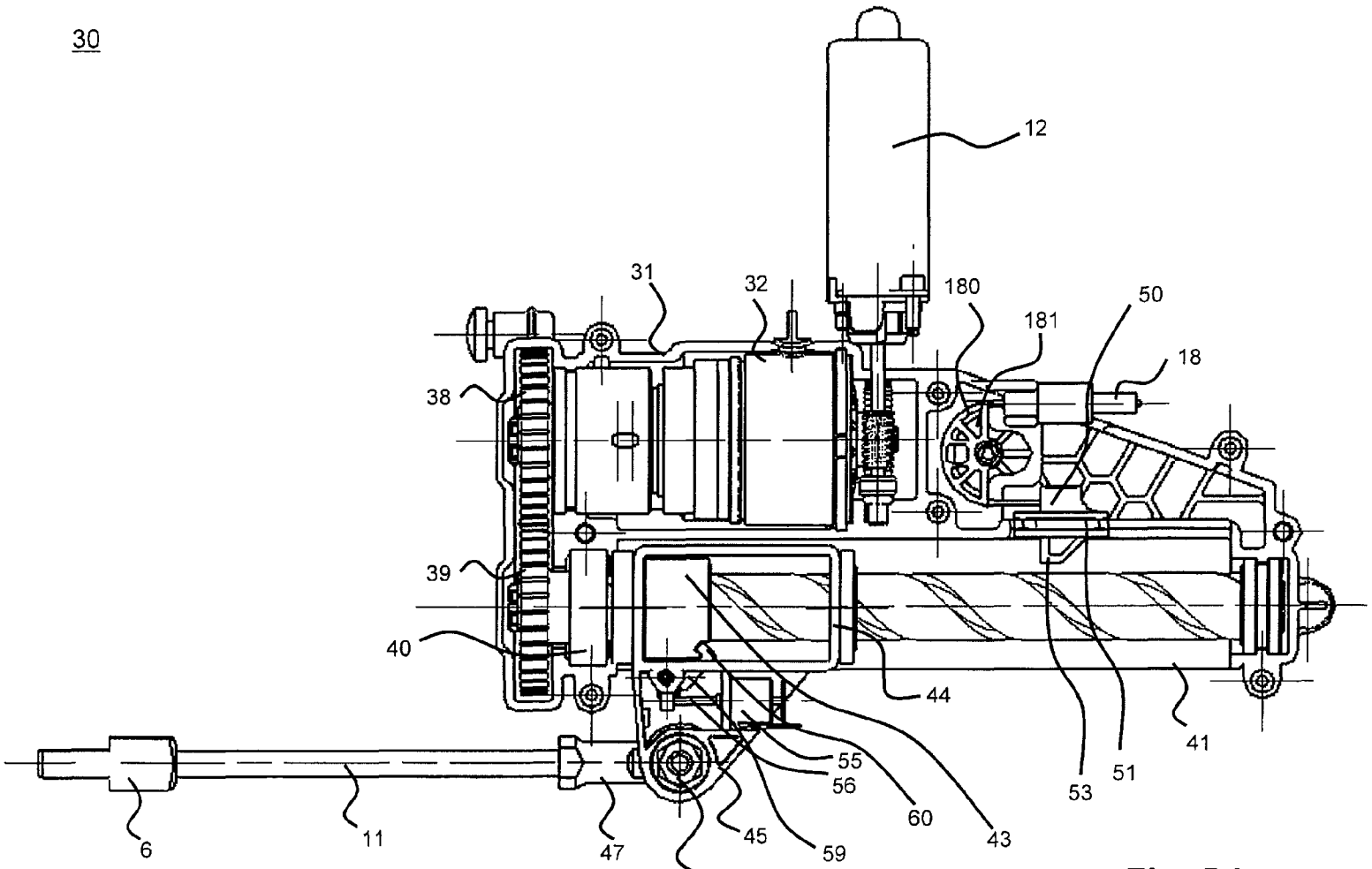

The clutch 32 is open in all of the phases according to FIGS. 5*a*-5*d*, so that the rotational movement of the spindle 41 is not braked by the friction linings of the clutch 32 pressing against one another. Only when the door is pivoted open to the maximum extent according to FIG. 5*d* is the clutch 32 actuated and closed by the electronic control unit in order to brake the rotational movement of the spindle 41 and ensure end stop damping.

As described hereinbefore, according to another embodiment, a distance sensor can permanently monitor the outer surface of the door for collision with obstacles. If the electronic control unit detects that there is a risk of collision between the vehicle door and an obstacle, according to this further embodiment, the clutch 32 can be closed at any time during the manual pivoting open operation of the door in order to brake the pivoting movement of the door by braking and subsequently blocking the rotational movement of the spindle 41 and to hold the door at rest (collision protection). The arresting action of the clutch 32 can be overcome by pivoting the door inwards manually. If this is detected by the door sensor, the electronic control unit releases the clutch 32 again in order to allow the vehicle door to be pivoted closed. Or, the electronic control unit cancels the arresting of the door by releasing the clutch 32 once a predetermined interval has elapsed.

Departing from the state according to FIG. 5*d*, the door can be pivoted closed or slammed shut manually. During the manual pivoting closed operation, the coupling rod 11 presses the running carriage 45 with the spindle nut 43 locked in place therein to the right once again. During the manual pivoting closed operation, the motor 12 remains switched off and the clutch 32 open.

Finally, the aforementioned second angular range or movement range is reached, as detected by the door sensor and the electronic control unit, in which the rotational movement of the spindle 41 is braked by suitable closing of the clutch 32, until a setpoint state of movement of the door is finally reached at the end of the aforementioned second angular range, in which, e.g. the maximum angular speed or kinetic energy of the door does not exceed a preset maximum value.

In order to brake the rotational movement of the spindle 41, the clutch 32 can be closed permanently by a force predetermined by the electronic control unit in order to brake the rotational movement in a controlled manner in accordance with a characteristic curve predetermined by the electronic control unit. Alternatively, the rotational movement of the spindle 41 can also be braked by alternating closing and opening of the clutch 32 in accordance with a braking characteristic curve predetermined by the electronic control unit.

Finally, in the case of a door opening angle predetermined by the electronic control unit, the aforementioned third opening range of the door is reached, in which the electric motor 12 is switched on and the clutch 32 closed, so that the motor 12 moves the running carriage 45 and the spindle nut 43 coupled thereto further to the right at a speed predetermined by the electronic control unit by rotating the spindle 41, towards the closed position according to FIG. 5*a*. In this regard the running carriage 45 pulls the coupling rod 11 further to the right in order to further power close the door. In this state, the door is no longer pivoted closed or slammed shut manually. On the contrary, the door is further power closed automatically, driven by the electric motor 12. Should the operator inadvertently slam the door shut further in this phase, this would be noticed by the door sensor and the electronic control unit and this process would be counteracted in a suitable manner by corresponding actuation of the electric motor 12 and/or the clutch 32, in particular in order to prevent the maximum closing speed or kinetic energy of the door predetermined by the electronic control unit from being exceeded.

When the door is power closed further, the running carriage 45 with the spindle nut 43 coupled thereto is adjusted further to the right until the tab 53 of the driving element 50 finally engages once again in the corresponding recess on the outer circumference of the spindle nut 43. The braking and drive unit 30 is thus finally transferred to the state according to FIG. 5*a* in which the door lock is situated in the pre catch.

As described hereinbefore, the braking and drive unit allows for continuous, smooth braking of the door to a desired state of movement preset by an electronic control unit. When the door is pivoted open, it can be stopped at any time if there is a risk of collision with an obstacle. The door is closed in that the operator simply slams the door shut. The door is thus braked to such an extent that the residual kinetic energy of the door at the end of the aforementioned second range is no longer sufficient for automatic closing and/or locking of the door. When the aforementioned third range is reached, on the other hand, a power closing device is activated automatically and power closes the door automatically at least to the pre catch. Motor-driven locking of the door lock is then effected. The operator very rapidly gets used to this sequence of movements, so that, after corresponding habituation, the operator will slam the vehicle door shut with only comparatively little force already sufficient to transfer the door without excessive action by the braking device to the aforementioned third movement range in which the power closing device acts automatically in order to close the door. Excessive slamming of the door is therefore prevented as a result of the habituation effect of the operator. The simpler design of the functional elements of the vehicle door and their suspension or bearing arrangements made possible as a result allows for considerable cost savings according to the invention.

Figure 6:
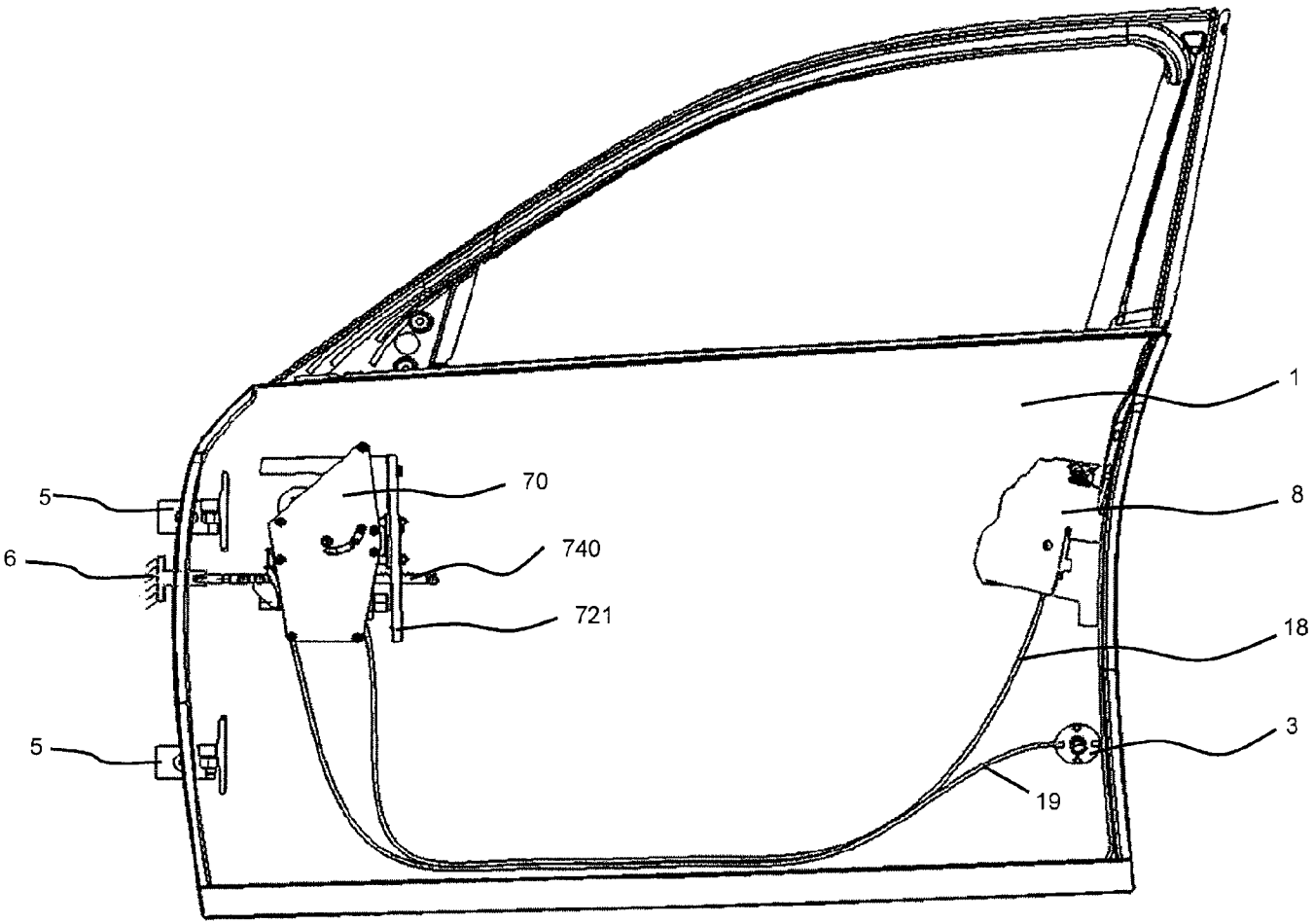
FIG. 6 is a schematic side view showing a motor vehicle door with a purely mechanical door closing system according to FIG. 3*b;*

The aforementioned functionality can also be achieved by means of a drive and braking unit operating without an electronic control unit, and will now be described by way of example with reference to FIGS. 6-14*b*. FIG. 6 is a diagram showing a motor vehicle door 1 with a purely mechanical door closing system according to the present invention. The door 1 is suspended from the door hinges 5. A braking and drive unit 70 is provided in the door 1 and is hinged by means of a pivotably supported coupling rod 11 with a rack 740 provided thereon to a fixed reference or coupling region 6 on the vehicle body. A damping or braking device is provided in order to brake the door during the pivoting closed operation, as described hereinafter. The unit 70 is coupled by means of a Bowden cable 18 to the door lock 8 in order to lock the door lock 8. A mechanical distance feeler 3 which actuates a Bowden cable 19 coupled to the unit 70 establishes when the door is almost completely closed, in particular when a pre catch of the door lock has been reached. If the distance feeler 3 is triggered, a locking mechanism is actuated and triggered by means of the Bowden cable 19 and transfers the door lock 8 into the main catch or locks it by means of the Bowden cable 18.

Figure 7:
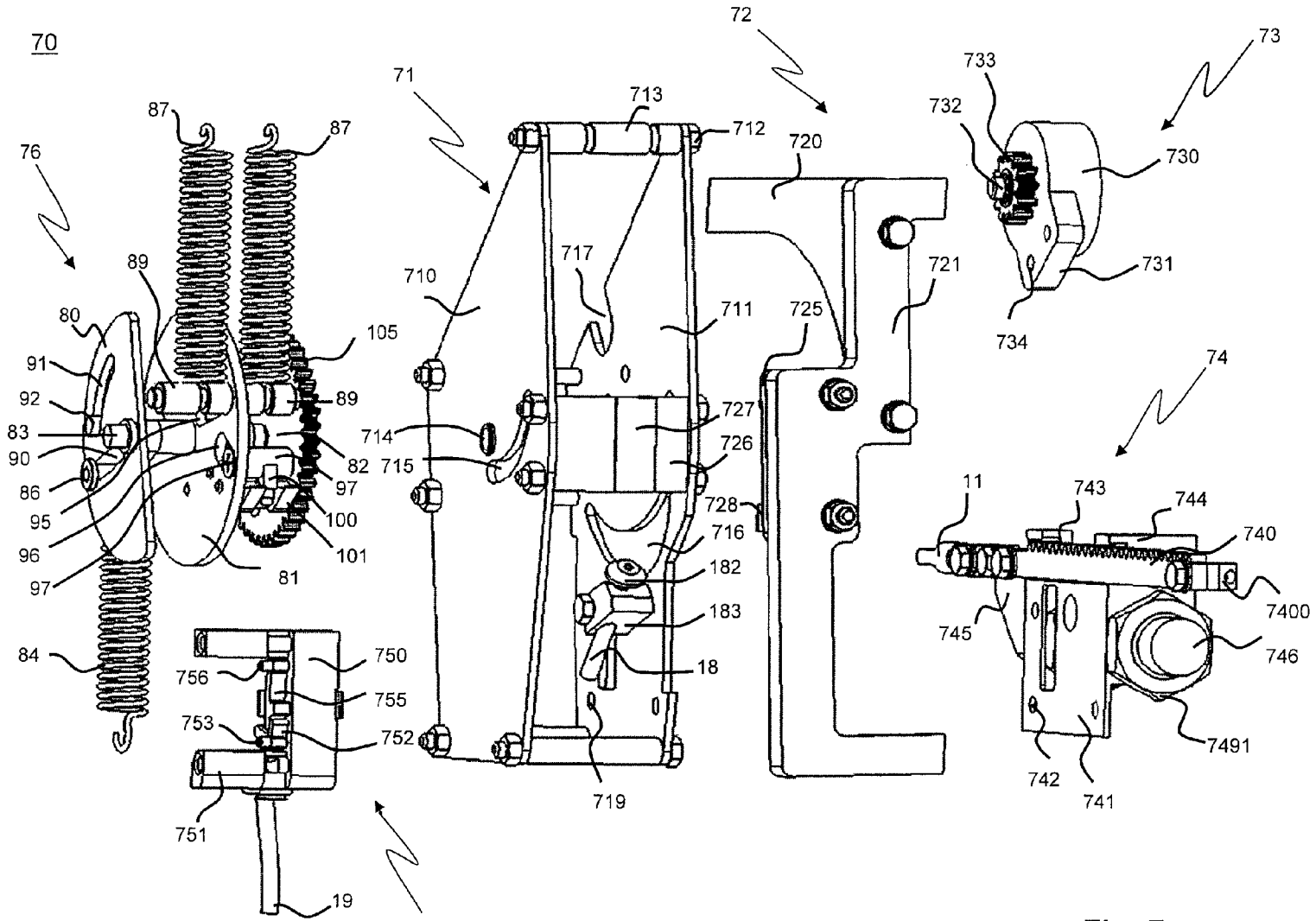
FIG. 7 is an exploded view showing an exemplary embodiment of a purely mechanical door closing system according to this invention.

FIG. 7 shows the mechanical braking and drive unit 70 in an exploded view. A Bowden cable bearing piece 183 receiving the Bowden cable 18 is fastened in the housing 71 and a mechanical energy storage and drive unit 76 is also received therein. A coupling unit 75 for coupling the door distance feeler 3 (cf. FIG. 6) to the unit 70 is furthermore mounted on the edge of the housing 71 so that the latch mechanism formed by two pivoted levers 752, 755 can cooperate with a circumferential projection of the central rotary disc 81 of the energy storage and drive unit 76 acting as a guide link, as described hereinafter. A door arrester unit 73 is furthermore arranged at the upper edge of the housing 71. Finally, a braking or damping unit 74 having a hydraulic damper 746 is mounted on the rear face of the housing 71 and also carries the coupling rod 11 with the rack 740 provided thereon. An angle bracket 72 is fastened to the front end face of the housing 71.

More precisely, the energy storage and drive unit 76 includes three discs 80, 81 and 82 rotatably mounted at a distance from one another. The discs 80-82 are mounted to rotate about the central pivot 83 supported in a pivot bearing region 714 of the left housing plate 710 of the housing 71 and an opposing bearing region in the right housing plate 711. The discs 80, 82 are connected together in a torsion-resistant manner by means of the pivot. The central rotary disc 81 can be rotated relative to the unit formed by the discs 80, 82. The left rotary disc 80 is semi-circular with a substantially radially extending guide slot 90 in which a spring suspension bolt 86 slidably guided therein is supported and in which the upper end of the tension spring 84 is suspended, as well as with an arcuate guide slot 91 extending over an angular range of approximately 45° in which a guide bolt 92 is slidably supported. A spring suspension bolt 89 is slidably supported in a substantially radially extending guide slot 95 on the central rotary disc 81, the lower end of a tension spring, or in the embodiment according to FIG. 7 preferably two tension springs 87, being suspended in the spring suspension bolt 89. The central and the right rotary discs 81, 82 are furthermore connected together by means of a guide bolt 97 screwed into the guide slot 96 serving for movement. A pressing-down means 100 and two lateral hook-shaped driving elements 101 arranged at a distance therefrom are provided on the guide bolt 97 and press down or carry along the mushroom-shaped cable nipple 182 of the Bowden cable 18 mounted in the interior of the housing 71, as described hereinafter.

The energy storage and drive unit 76 is mounted in the housing 71 in such a manner that the left and central rotary discs 80, 81 are mounted in the interior of the housing, while the right rotary disc 82 is mounted outside the housing 71 on the rear face thereof, so that the bolt 97 projects through the sickle-shaped recess 716 formed in the right housing plate 711. The housing plates 710, 711 are rigidly connected together by means of a plurality of screw bolts 712 with spacer sleeves 713 provided therebetween. As shown in FIG. 7, two circular recesses in which the upper ends of the tension springs 87 are suspended are formed in the upper spacer sleeve 713. The lower end of the tension spring 84 is suspended in a corresponding spacer sleeve on the rear lower end of the housing 71. As described hereinafter, the springs 87 serve to lock the door lock by actuating the Bowden cable 18, while the tension spring 84 serves to power close the door in the aforementioned third door movement range. The tension springs 87 and 84 can consequently be relaxed independently of one another, to which end the central rotary disc 81 is mounted to rotate relative to the left and right rotary discs 80, 82.

The door arrester unit 73 is fastened to the right housing plate 711 in such a manner that the axis 732 projects through the recess 717 on the upper edge of the right housing plate 711 and the gear 733 meshes with the outer teeth 105 of the right rotary disc 82. The right rotary disc 82 therefore serves as a drive for the unit 70. A braking system with a high break-away torque, in particular a defined break-away torque, serves as the door arrester 73, the continuing torque being small so that once the high break-away torque has been overcome (overcoming the holding force of the door), the door can be moved further smoothly once again. A braking system of this kind can be produced for example in the known manner by means of a wrap spring or the like.

According to FIG. 7, a bearing plate 726 connecting the two housing plates 710, 711 together and in which a semi-cylindrical journal receiver 727 is formed is fastened to the front edge of the housing 71. Together with the journal retaining plate 725 with journal bearing arrangements 728 mounted on the mounting base 721 of the angle bracket 72, the housing 71 is mounted in this region to rotate about these journals (not shown in the Figures) relative to the angle bracket 72 rigidly connected to the frame of the vehicle door so as to obtain angular compensation when pivoting the door.

Figure 8B:
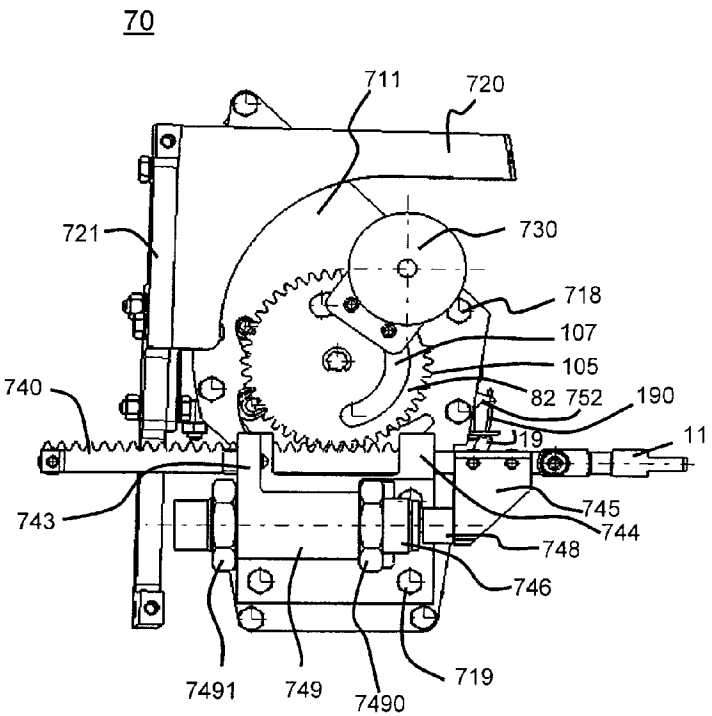
FIGS. 8*a* and 8*b* are front and rear views respectively of the door closing system according to FIG. 7 with the door completely closed.

The damping unit 74 includes a base plate 741 with two supporting brackets 743, 744 provided thereon, between which, according to FIG. 8*d*, there is formed a bearing sleeve 749 in which the cylinder 746 of a hydraulic damper is received, fastened by means of screws 7490 and 7491 to the bearing sleeve 749. The base plate 741 is fastened by means of fastening means, e.g. screws, projecting through the mounting holes 742 and the corresponding mounting holes 719 to the rear face of the right housing plate 711 so that the outer teeth 105 of the right rotary disc 82 mounted outside the housing 71 on the rear face thereof meshes with the rack 740 provided on the coupling rod 11. As shown in FIG. 6, the front end of the coupling rod is pivotably hinged to the fixed reference or coupling region 6 on the vehicle body. According to FIG. 8*b*, an angled actuating element 745 is provided at the front end of the coupling rod 11 and in certain angular ranges of the door, as described hereinafter, comes to bear against the actuating end 748 of the piston rod of the piston mounted in the cylinder 746. The opening position of the door is detected mechanically by the cooperation of the actuating element 745 and the actuating end 748 of the piston of the damping cylinder 746 and the closing movement of the door is damped in predetermined angular ranges, as predetermined by the geometry of the component. The hydraulic or pneumatic damping cylinder 746 is preferably designed in such a manner that its damping or braking rate increases as the closing speed of the door increases, preferably in a non-linear manner. If the door is thus closed slowly, the braking or damping effect is negligible, while if the door is slammed shut hard, the damping or braking effect is considerable.

As shown for example in FIG. 8*a*, a circumferential projection 110 is formed on the outer circumference of the central rotary disc 81 and, in cooperation with the latch mechanism formed by the two pivoted levers 752 and 755 pivotable in opposite directions, controls the rotational movement of the central rotary disc 81 in order to trigger locking of the door lock by means of the Bowden cable 18, as described hereinafter.

The method of operation of the mechanical braking and drive unit according to FIG. 7 will now be described with reference to FIGS. 8*a*-14*b* in the case of the opening and closing of the vehicle door and locking of the door lock. In this regard, the mechanical braking and drive unit is shown in a front view in the Figures designated by the letter a and the unit is shown in a corresponding rear view in the drawings designated by the letter b.

Figure 8A:
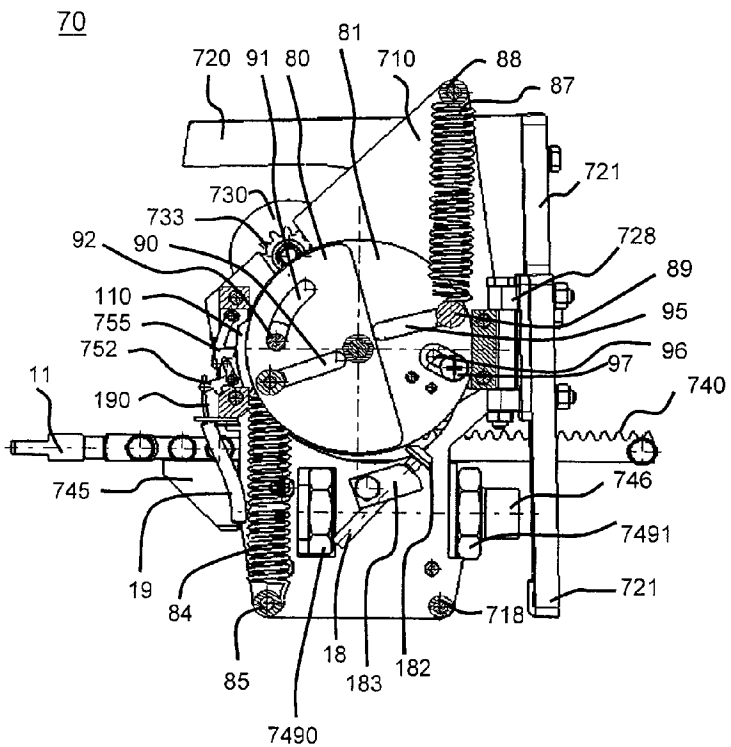

The case of a vehicle door completely closed and held closed will be taken as the initial state, as shown in FIGS. 8*a* and 8*b*. In this position, the coupling rod 11 is moved into an end position damped or arrested by the cooperation of the actuating element 745 and the actuating end 748 of the damping cylinder 746. In this position, the springs 84, 87 are relaxed and the latch of the upper pivoted lever 755 bears against the outer circumference of the circumferential projection 110 without blocking the latter and the rotational movement of the central rotary disc 81.

Figure 9B:
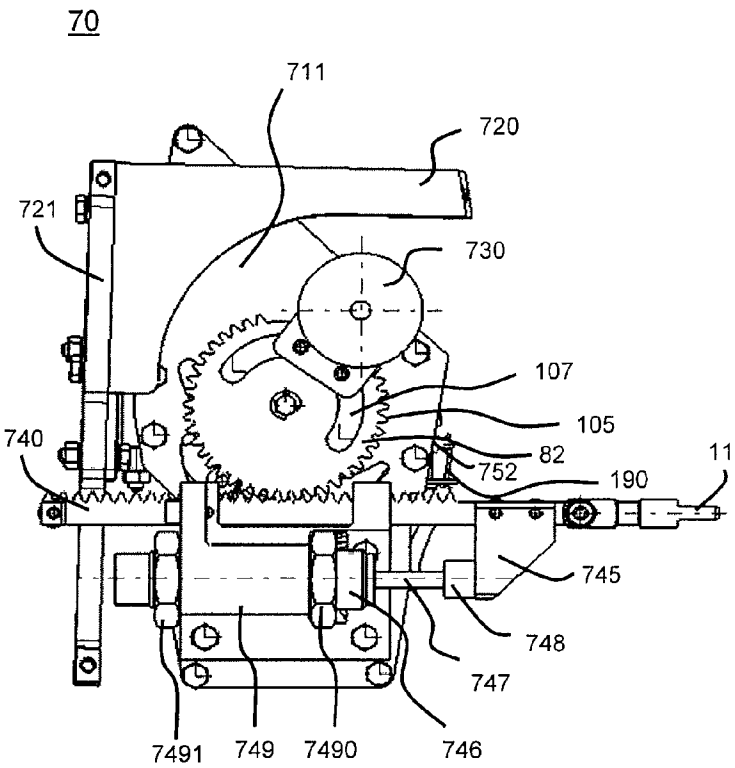
FIGS. 9*a* and 9*b* are front and rear views respectively of the door closing system according to FIG. 7 with the door partially open.
Figure 9A:
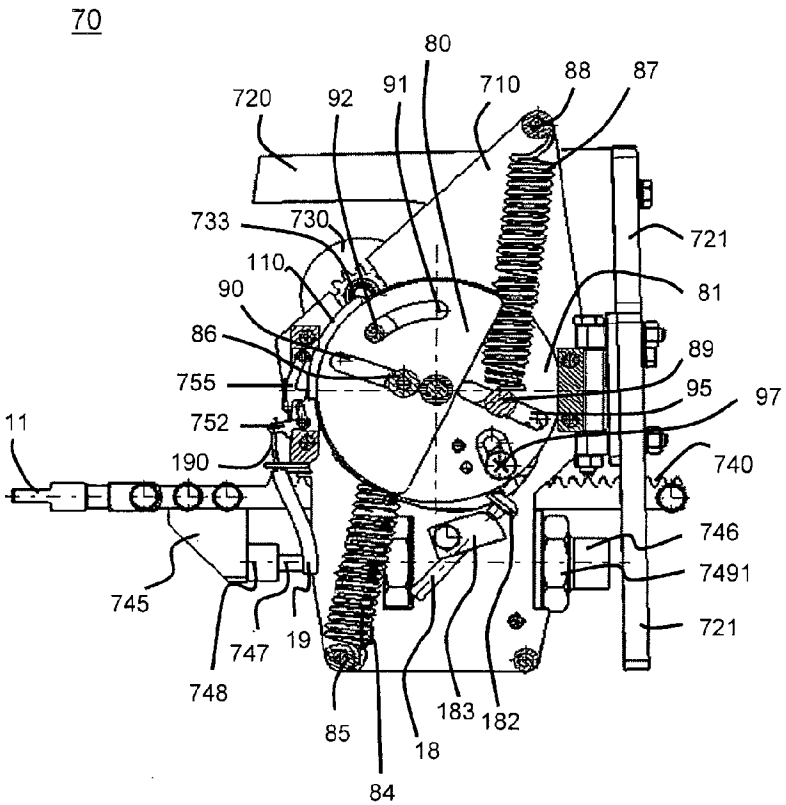

FIGS. 9*a* and 9*b* show the unit 70 once the door has been pivoted open by approximately 19°. The coupling rod with the rack 740 has moved slightly compared to FIGS. 8*a* and 8*b*, as a result of which the right rotary disc 82 meshing with the rack 740 by means of its outer teeth 105 was rotated and the rotary discs 81 and 80 situated in the rotary end stop were also carried along. The springs 84, 87 are thus pretensioned. Whereas the spring suspension bolt 86 of the tension spring 84 has already passed completely through the guide slot 90, the corresponding spring suspension bolt 89 of the tension spring 87 is situated approximately in the centre of the associated guide slot 95. According to FIG. 9*a*, the lower pivoted lever 752 is snapped back in a clockwise direction and bears against the lower end of the circumferential projection 110 in order to prevent the central rotary disc 81 from rotating in reverse. As shown in FIG. 9*b*, in this position, the piston rod 747 of the damping cylinder 746 is almost completely extended, although the actuating end 748 of the piston rod 747 furthermore bears against the actuating element 745 of the coupling rod 11.

Figure 10B:
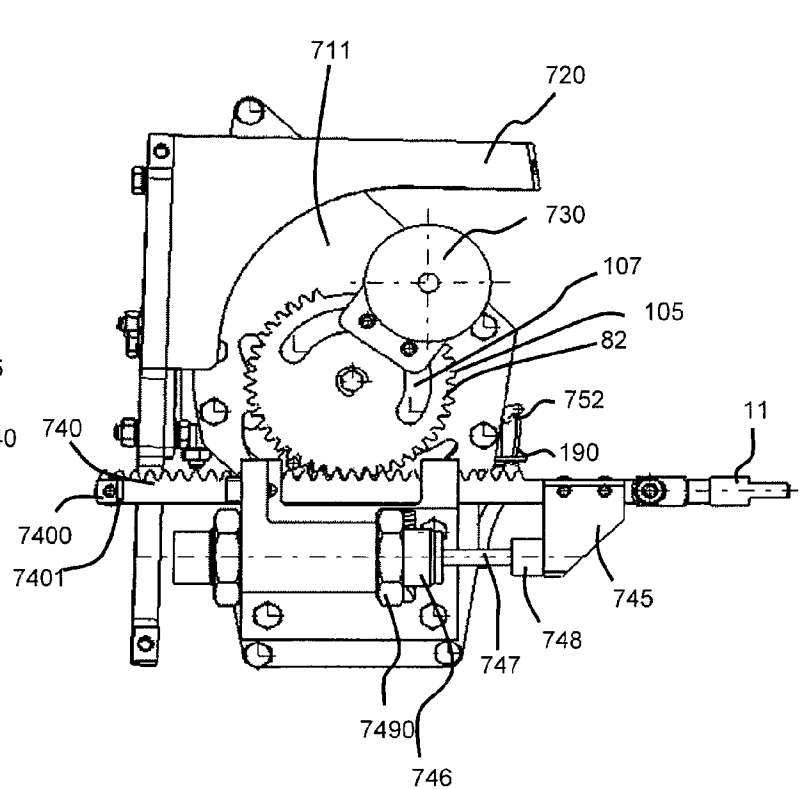
FIGS. 10*a* and 10*b* are front and rear views respectively of the door closing system according to FIG. 7 with the door opened a bit further.
Figure 10A:
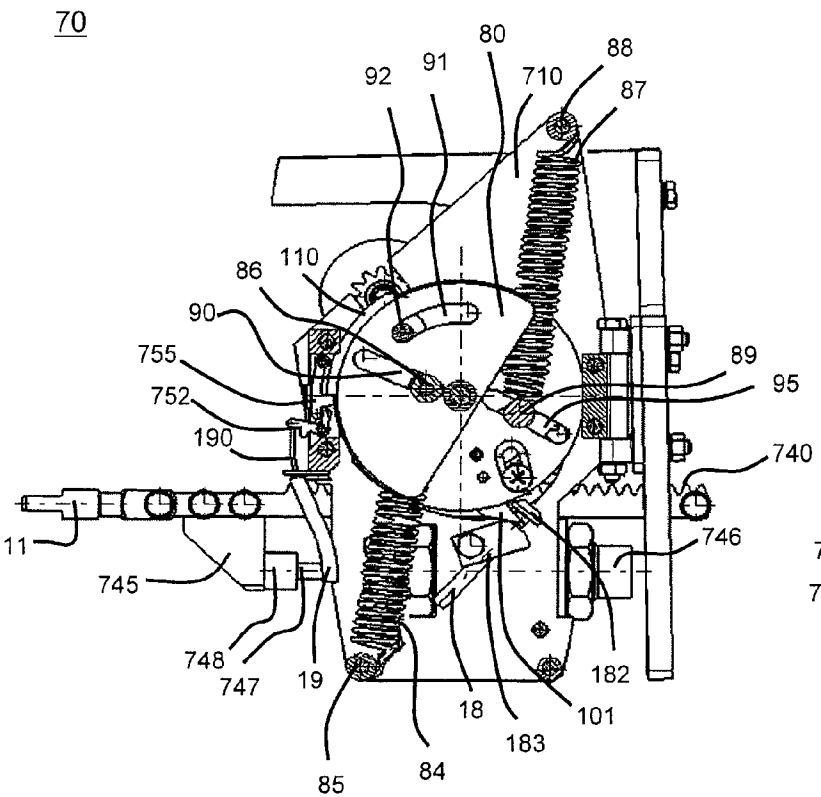

FIGS. 10*a* and 10*b* show the unit 70 after manual pivoting open of the door by approximately 21°. The springs 84, 87 are further pretensioned in this state. In addition to the pretensioned lower pivoted lever 752, the pretensioned upper pivoted lever 755 is now also pivoted backwards in a counterclockwise direction so that the latch mechanism formed jointly by the pivoted levers 752, 755 cooperates with the circumferential projection 110 in order to prevent the central rotary disc 81 from rotating in reverse. In other words, the latch mechanism prevents the tension springs 87 serving to lock the door lock from relaxing. As shown in FIG. 10*a*, in the position according to FIG. 10*a*, the two driving elements 101 have moved past the mushroom-shaped cable nipple 182 of the Bowden cable 18 in a clockwise direction and they are therefore ready for actuation of the Bowden cable 18 by engaging behind the cable nipple 182 and rotating the central rotary disc 81 in the opposite direction. As shown in FIG. 10*b*, in this position, the actuating element 745 of the coupling rod 11 also bears against the actuating end 748 of the piston rod 747 of the damping cylinder 746.

Figure 11B:
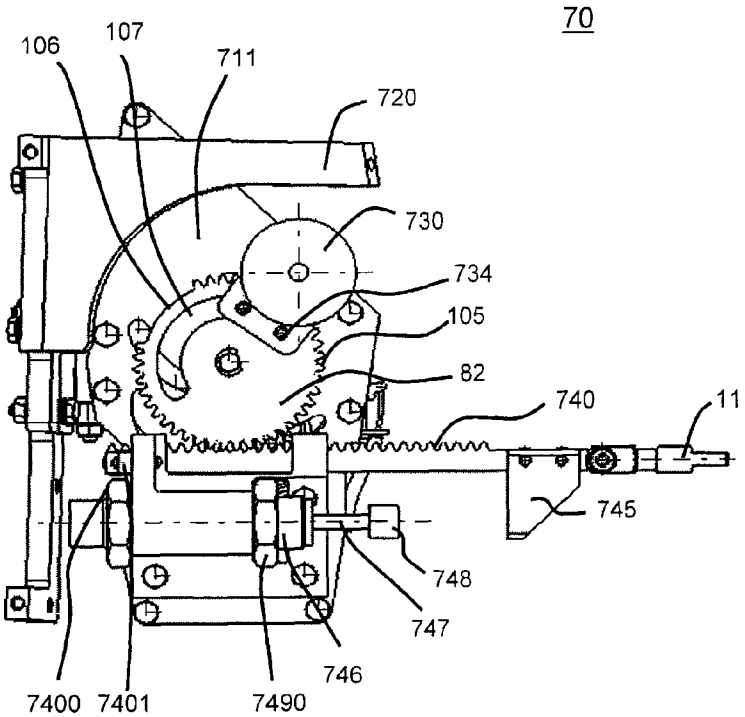
FIGS. 11*a* and 11*b* are front and rear views respectively of the door closing system according to FIG. 7 with the door opened to the maximum extent.
Figure 11A:
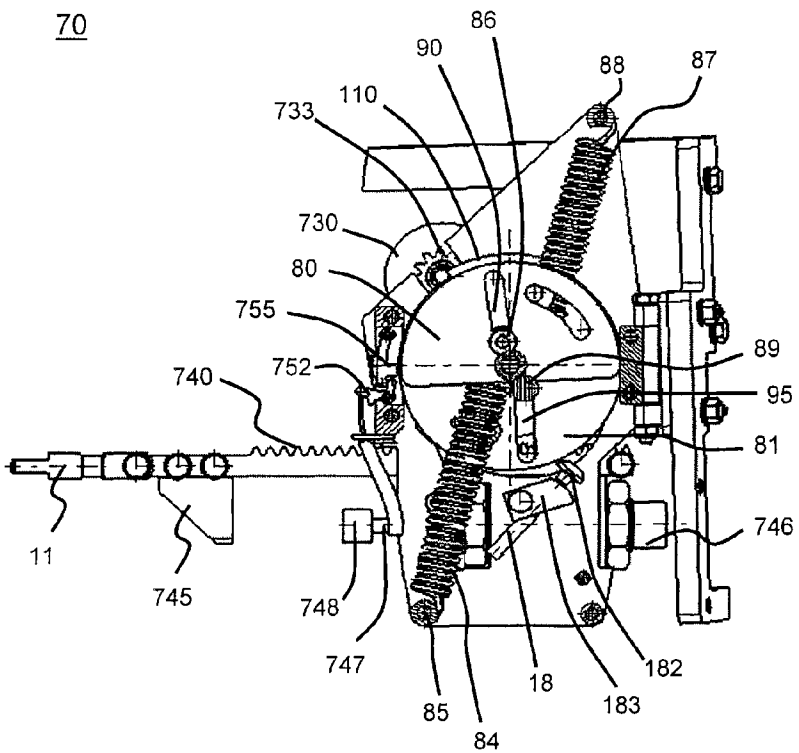

Further manual pivoting open of the door finally results in the state according to FIGS. 11*a* and 11*b*, in which the springs 84, 87 are completely tensioned and a resilient damping stop 7401 provided on the angled end piece 7400 of the rack 740 and/or a corresponding damping element on resilient damping elements provided in the sliding piece bearing regions 734 of the door arrester unit 730, in cooperation with the arcuate guide slot 107 of the right rotary disc 82, ensure(s) a damped end stop in order to stop the door movement. As shown in FIG. 11*b*, in this position, the piston rod 747 is completely extended from the damping cylinder 746, although there is a clear gap between the actuating element 745 of the coupling rod 11 and the actuating end 748 by means of which it is possible to control the beginning of the damping effect of the damping cylinder 746 when the door is pivoted closed.

Figure 12B:
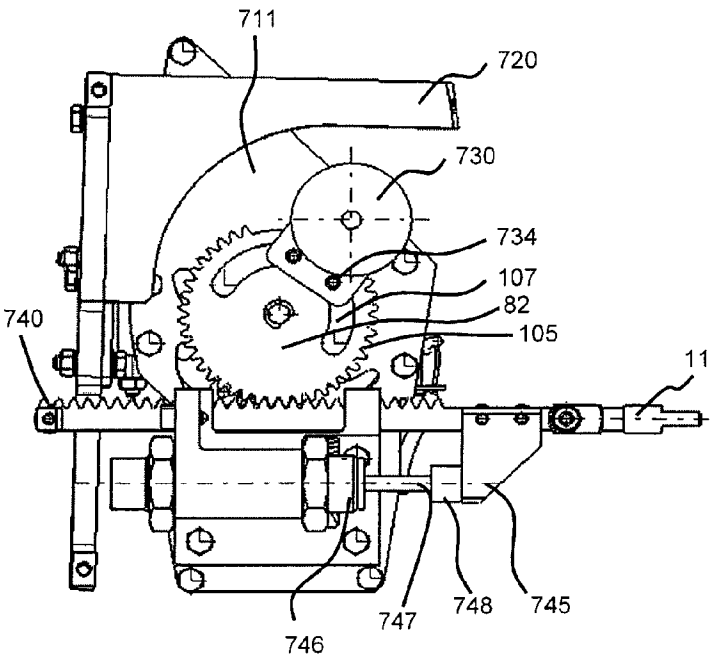
FIGS. 12*a* and 12*b* are front and rear views respectively of the door closing system according to FIG. 7 with the door partially closed.
Figure 12A:
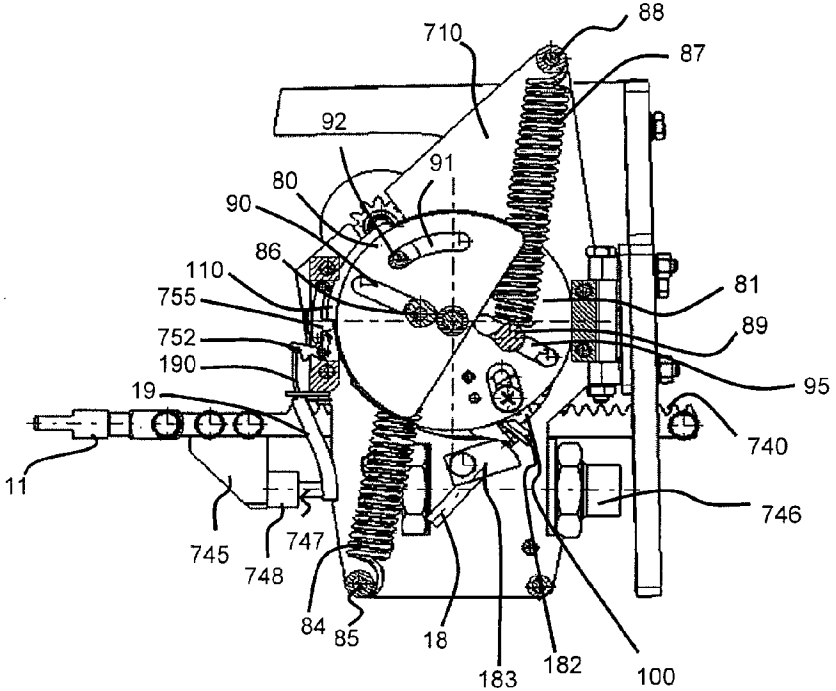

Pivoting the door closed finally results in the state according to FIGS. 12*a* and 12*b*, in which the springs 84, 87 are further relaxed, although the latch mechanism formed by the pivoted levers 752, 755, in cooperation with the circumferential projection 110, prevents the central rotary disc 81 from rotating in reverse and therefore prevents the tension springs 87 driving the locking of the door lock from relaxing. According to FIG. 12*b*, in this position, the actuating element 745 once again bears against the actuating end 748 of the piston rod 747 of the damping cylinder 746 in order to damp the slamming of the door, as predetermined by the characteristic curve of the damping cylinder 746. As will be clear from FIG. 12*a*, however, in this position, the tension spring 87 serving to power close the door acts furthermore on the left rotary disc 80 and the right rotary disc 82 coupled thereto in order to rotate them further until the closed position of the door is finally reached. The force exerted by the tension spring 84 is comparatively small, but sufficient to power close the door in a reliable manner against the damping or braking force exerted by the damping cylinder 746.

A damping cylinder the braking or damping rate of which is high for high door closing speeds, but low for low door closing speeds is advantageously used to this end. A small tensile force exerted by the tension spring 84 is therefore already sufficient to power close the door in a reliable manner against the damping or braking force exerted by the damping cylinder 746.

Figure 13B:
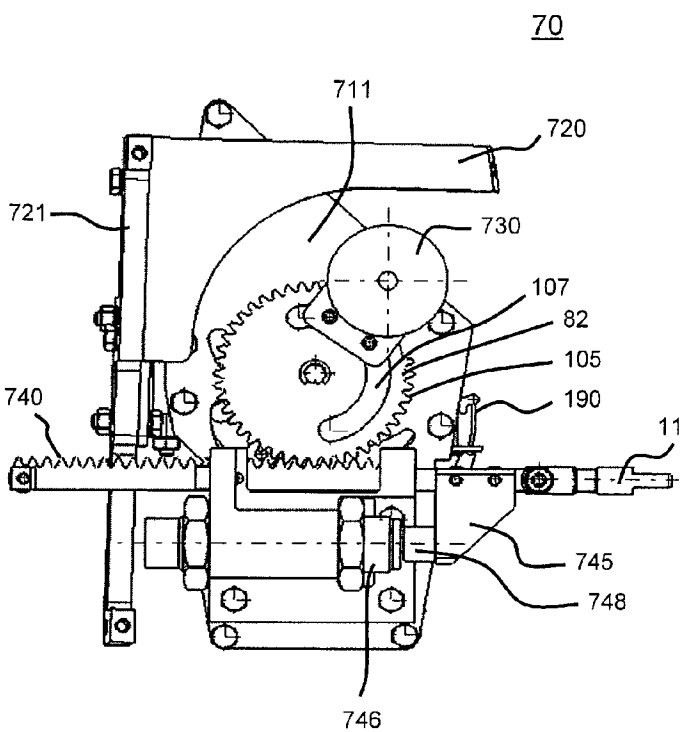
FIGS. 13*a* and 13*b* are front and rear views respectively of the door closing system according to FIG. 7 with the door virtually completely closed immediately before the door lock is locked.
Figure 13A:
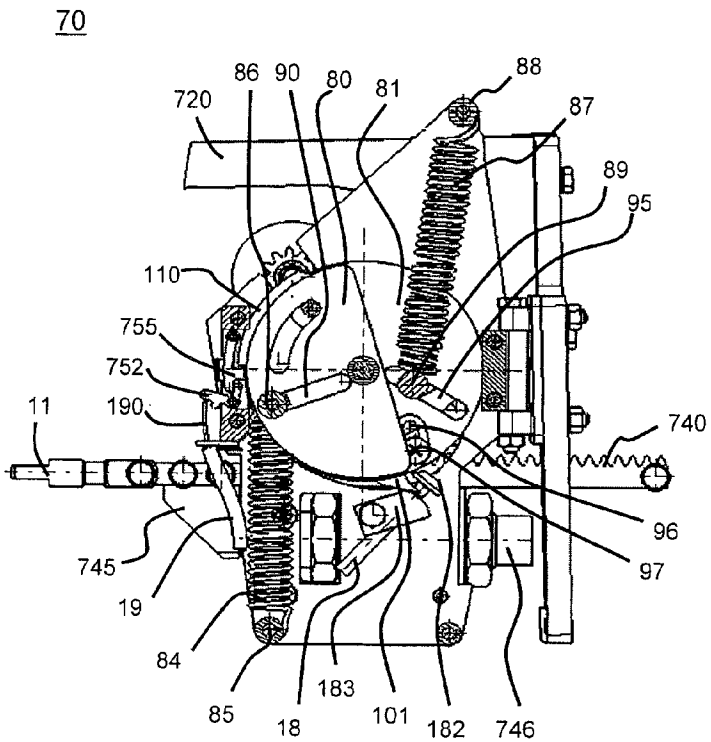

Power closing the door further finally results in the position according to FIGS. 13*a* and 13*b*, in which the door is almost completely closed, but the door lock is still not locked. In this position, the tension spring 84 is tensioned further and acts on the door so as to power close it further against the counter force exerted by the door seal. According to FIG. 13*a*, the circumferential projection 110 also cooperates furthermore with the latch mechanism formed by the two pivoted levers 752, 755 in order to prevent the central rotary disc 81 from rotating in reverse and also furthermore to prevent the tension springs 87 from relaxing.

Figure 14B:
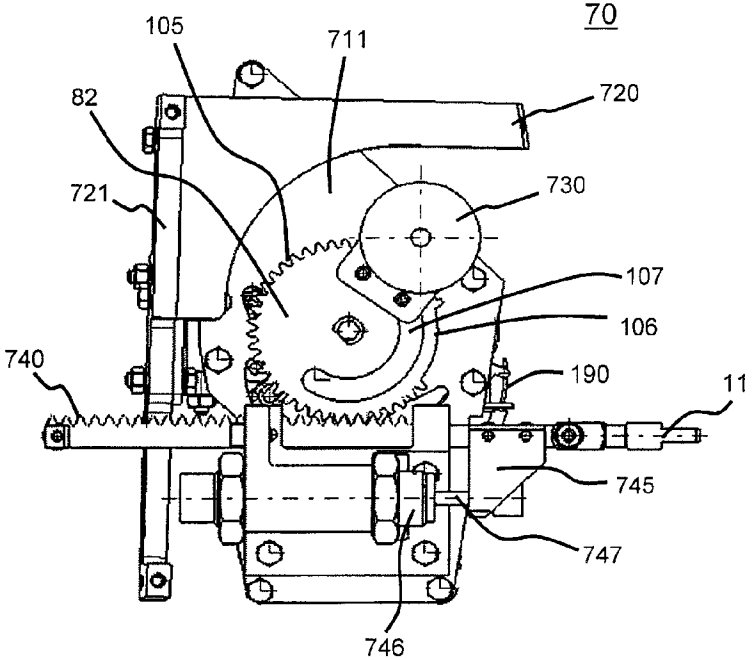
FIGS. 14*a* and 14*b* are front and rear views respectively of the door closing system according to FIG. 7 with the door completely closed when the door lock is locked.
Figure 14A:
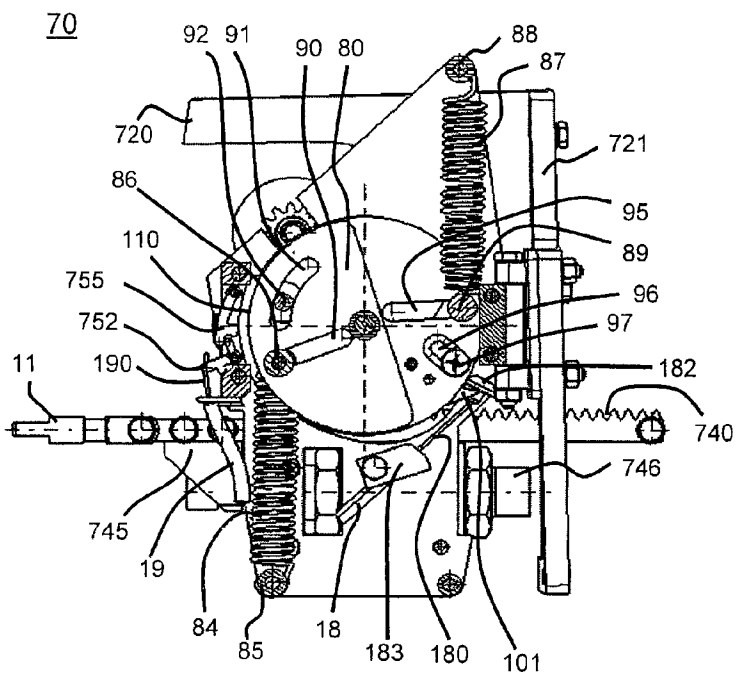

Power closing the door further, driven by the tension spring 84, finally results in the state according to FIGS. 14*a* and 14*b*, in which the door is completely closed and the unit 70 drives locking of the door lock, as described hereinafter. In the state according to FIGS. 14*a* and 14*b*, the door has reached the pre catch. The rear end of the door is situated such a short distance from the B-column of the vehicle that the distance feeler 3 (cf. FIG. 6) finally pulls so hard on the cable of the Bowden cable 19 that the latch mechanism formed by the two pivoted levers 752, 755 is triggered in order to release the circumferential projection 110 so that the springs 87 can relax and the spring energy stored thereby can be released within a very short period of time. According to FIG. 13*a*, when the door is almost completely closed, the driving element 101 is arranged in the immediate vicinity of the mushroom-shaped cable nipple 182 of the Bowden cable 18 in order to engage behind the latter. If the circumferential projection 110 is then released from the latch mechanism according to FIG. 14*a*, the central rotary disc 81 is rotated rapidly in a counter-clockwise direction according to FIG. 14*a*, driven by the relaxing of the tension springs 87. In this regard, the driving elements 101 engaging behind the cable nipple 182 carry the cable nipple 182 along with them in a counter-clockwise direction so that the cable 180 of the Bowden cable 18 is actuated, as a result of which the latch of the door lock coupled to the cable 180 is locked. The vehicle door is thus transferred to the main catch. Finally, the two driving elements 101 slide past the cable nipple 182, as a result of which the cable 180 with the cable nipple 182 moves back into the Bowden cable 18 and the unit 70 once again assumes the state according to FIGS. 8*a* and 8*b*. In this state, the door is held closed in the main catch.

As described hereinbefore, the door is also braked in a controlled manner in the second movement range by the mechanical braking and drive unit according to FIG. 7, until a state of movement predetermined by the characteristic curve of the braking or damping device is reached at the end of the second movement range, in which the door cannot be closed and/or locked automatically. In the following third door movement range, the door is power closed automatically as a result of a spring-actuated power closing mechanism until a pre catch is finally reached. The spring mechanism provided to drive the door locking mechanism is then triggered, the door lock locked and the door therefore transferred to a main catch. In this door closing system once again, a certain habituation effect sets in, as a result of which the operator expects the door to be braked in the second door movement range so that it is pointless to slam the door shut too hard. In any case, the door is automatically power closed and locked once the third door movement range is reached.

As will be readily clear to the person skilled in the art studying the preceding description, the spring mechanism of the energy storage and drive unit 76 according to FIG. 7 acting as the energy storage device can also be replaced by any other energy storage device, e.g. pneumatic or hydraulic cylinder/piston/damping units, magnetic or electrical energy storage devices or even energy storage devices which store energy in the form of potential energy. As described hereinbefore with reference to FIG. 3*c*, a mechanical energy storage device of this kind can also be charged with the aid of a servomotor provided in the door or in the vehicle body and serving for another movement movement, e.g. by a window lifter motor, a lock drive, a central locking motor or an electric arm rest servomotor. An additional clutch and gear mechanism for coupling this servomotor to the mechanical energy storage device has to be provided to this end, as will be readily clear to the person skilled in the art. The control of this additional servomotor and the further clutch and gear unit can be effected by mechanical feelers and/or an electronic control device.

Instead of the hydraulic or pneumatic damping and braking cylinder 746 according to FIG. 7, any other desired damping and braking device can also be provided in the mechanical braking and drive unit 70 according to FIG. 7, e.g. an electrical or magnetic braking and damping mechanism, which will be readily clear to the person skilled in the art. An electrical braking and damping mechanism of this kind can also convert kinetic energy into electrical energy during the braking of the door movement, for example in the manner of a known eddy-current brake. This electrical energy can be supplied to the on-board power supply of the motor vehicle.

As described hereinbefore, the speed of the drive unit for locking the door lock and transferring the door from the pre catch to the main catch is reduced to a considerable extent, so that even comparatively large counter forces as a result of seals on the edge of the body opening can be overcome in a simple manner.

Although the door closing system according to the invention has been described hereinbefore with reference to a motor vehicle hinged door, the door closing system according to the invention is also suitable for any manually closable body components of motor vehicles, e.g. sliding doors, hinged/sliding doors, bonnets, hinged covers, sliding roofs or the like. In principle, however, the door closing system according to the invention is also suitable in a corresponding manner for manually closable closing elements of any track-bound or rail-bound vehicles, such as, e.g. doors of railway carriages or entrance doors of suburban railway vehicles or trams.

The door closing system according to the invention allows for the continuous, jam-free closing of closing elements of this kind. As a result of the comparatively low speed or comparatively low residual kinetic energy level of the closing element in the aforementioned third movement range, no dangerous state of jamming or pinch is possible according to the invention. Obstacles such as, e.g. a human hand or a body part, can easily push the closing element back in the third movement range. Greater force or pressure is only applied by the closing element once it has passed through the third movement range, i.e. when the closing element has already dropped into the pre catch, and the jamming or pinch of objects or body parts is prevented in a reliable manner. Only in the following fourth movement range is the closing element locked by locking the lock and thus completely power closed.

As a result of the considerably lower slamming energy of the closing element according to the invention, the stresses applied to functional elements of the closing element or their bearing arrangements as a result of the slamming of the closing element are reduced considerably, this allowing for a considerable potential saving according to the invention.

Legend

1 door
2 position sensor or feeler
3 distance sensor or feeler
4 pivot axis
5 door hinge
6 reference/coupling region (fixed)
7 control device
8 door lock
9 power closing aid
10 braking and drive unit
11 coupling means/coupling rod
12 electrical driving device
13 energy storage device
14 mechanical driving device
15 brake/damper
16 electric motor
18 Bowden cable of the power closing aid
180 cable of the power closing aid
181 cable deflection piece
182 cable nipple
183 Bowden cable bearing piece
19 Bowden cable of the distance feeler 3
190 cable
30 mechatronic braking and drive unit
31 housing
32 electromagnetic brake
33 drive shaft
34 screw
35 gear
36 gear stage
37 gear stage
38 gear
39 gear
40 bearing
41 spindle
42 bearing
43 spindle nut
44 spindle nut cage
45 running or sliding carriage
46 pivot axis
47 end piece
49 recess in the spindle nut 43
50 driving element
51 sliding guide
52 longitudinal rib of the housing 31
53 tab of the driving element 50
55 lifting magnet
56 lifter
57 stop surface
58 pivot axis
59 pivoted lever
60 hook/snap-in projection of the pivoted lever 59
70 mechanical braking and drive unit
71 housing
72 angle bracket
73 door arrester unit
74 damping unit
75 coupling unit of the door distance feeler 3
76 energy storage and drive unit
80 left rotary disc
81 central rotary disc
82 right rotary disc
83 central pivot
84 tension spring
85 fixed mounting region
86 slidable spring suspension bolt
87 tension spring
88 fixed mounting region
89 slidable spring suspension bolt
90 radial guide slot
91 arcuate guide slot
92 guide bolt
95 radial guide slot
96 guide slot
97 guide bolt
100 pressing-down means
101 driving element
105 outer teeth
106 tooth space section
107 arcuate guide slot
110 circumferential projection
710 left housing plate
711 right housing plate
712 screw bolt
713 spacer sleeve
714 pivot bearing region
715 eccentric guide
716 recess
717 recess
718 connecting region
719 mounting hole
720 fastening leg
721 mounting base
725 journal retaining plate
726 bearing plate
727 journal receiver
728 journal bearing arrangement
730 housing
731 fastening section
732 axis
733 gear
734 sliding piece bearing region
740 rack
7400 angled end piece
7401 resilient damping stop
741 base plate
742 mounting hole
743 supporting bracket
744 supporting bracket
745 actuating element
746 cylinder of the hydraulic damper
747 piston rod of the hydraulic damper
748 actuating end of the piston rod 747
749 bearing sleeve of the cylinder 746
7490 nut
7491 nut
750 base
751 web
752 lower pivoted lever
753 lower pivot axis
755 upper pivoted lever
756 upper pivot axis

The invention claimed is:

1. A device for controlling a closing movement of a manually closable body component for vehicles, comprising a braking device for braking a closing movement of said body component, a driving device for driving the closing movement of said body component and a clutch for selectively engaging or disengaging said braking device, wherein said braking device is coupled or can be coupled to the body component by means of said clutch in such a manner that:

during the closing movement, departing from an opened position, the body component passes through a first movement range in which said driving device is off and said clutch is open for disengaging said body component from said braking device and said driving device so that the body component is moved towards a closed position without restrictions and any action by said braking device, and, following the first movement range, the body component passes through a second movement range in which said driving device remains switched off while said clutch is suitably actuated such that the closing movement of the body component is braked by an action of the braking device such that a residual kinetic energy of the body component does not exceed a predetermined limit value after passing through the second movement range and arriving at a predetermined opening angle, which is larger than zero degrees, but that the residual kinetic energy is not sufficient to close the body component automatically or to transfer the body component to a pre catch or main catch of a lock of said body component, and said driving device is switched on and said clutch is closed for engaging a drive force of said driving device in a third movement range following the second movement range in such a manner that said driving device drives the closing movement of said body component in said third movement range to the pre catch or main catch of said lock.

2. The device according to claim 1, further comprising an energy storage device which is coupled or can be coupled to the driving device by means of said clutch in such a manner that the driving device is driven by exhausting the energy storage device.

3. The device according to claim 2, in which the energy storage device is coupled to an opening and/or closing movement of the body component by means of said clutch in such a manner that the energy storage device is replenished during the manual opening and/or closing of the body component by braking or damping an opening and/or closing movement.

4. The device according to claim 2, in which the energy storage device is coupled or can be coupled to a servomotor serving for an adjustment function other than the closing and/or opening of the body component in such a manner that the energy storage device can be replenished by operating the servomotor.

5. The device according to claim 4, in which the energy storage device is coupled or can be coupled to a window lifter motor, lock drive, central locking motor or electric arm rest servomotor in such a manner that the energy storage device can be replenished by operating the servomotor.

6. The device according to claim 1, in which the driving device is driven by an electric motor in order to drive the body component in the third movement range to the pre catch or main catch of the lock.

7. The device according to claim 1, in which the braking device is designed in such a manner that its braking rate increases as the closing speed of the body component increases.

8. The device according to claim 1, in which the clutch is furthermore designed as a braking device for braking the movement of the body component.

9. The device according to claim 1, further comprising an electronic control unit designed to couple at least one of the clutch and the driving device as required selectively to the adjustment movement of the body component.

10. The device according to claim 9, in which the electronic control unit is designed in such a manner that the clutch can be coupled as a function of at least one of the determined speed, acceleration of the closing movement and the determined closing path travelled by the body component.

11. The device according to claim 10, in which the electronic control unit is furthermore designed in such a manner that the clutch is coupled as a function of at least one of model or manufacturer of the body component, position of the vehicle, identification of a user of the vehicle and an output signal from a logic unit.

12. The device according to claim 9, further comprising a sensor in order, upon the opening of the body component, to monitor an outer surface thereof for collision with an obstacle, the electronic control unit triggering the arrest of the body component by means of the braking device or a door arrester when a state of collision is detected.

13. The device according to claim 10, in which the electronic control unit is furthermore designed in such a manner that limits between the movement ranges are varied as a function of at least one of determined speed, acceleration of the closing movement and determined closing path travelled by the body component.

14. The device according to claim 13, in which the electronic control unit is furthermore designed in such a manner that the limits between the movement ranges are varied as a function of at least one of the model or manufacturer of the body component, the position of the vehicle, the identification of a user of the vehicle and an output signal from a logic unit.

15. The device according to claim 1, in which the driving device is designed to adjust the body component into a position in which a pinch protection function is ensured in a reliable manner, a power closing device furthermore being associated with a lock of the body component in order to lock the lock departing from the pre catch.

16. The device according to claim 15, in which the power closing device can be coupled or is coupled to the driving device.

17. The device according to claim 15 or claim 16, further comprising a mechanical distance feeler or an electrical or electronic distance sensor in order to trigger locking of the lock automatically at the end of the third movement range.

18. The device according to claim 1, in which the motor vehicle body component is selected from a group including: hinged door, sliding door, hinged/sliding door, bonnet, hinged cover or sliding roof.

* * * * *